US008444446B2

(12) United States Patent
Kuriyagawa et al.

(10) Patent No.: US 8,444,446 B2
(45) Date of Patent: May 21, 2013

(54) OUTBOARD MOTOR CONTROL APPARATUS

(75) Inventors: Koji Kuriyagawa, Saitama (JP); Hajime Yoshimura, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 295 days.

(21) Appl. No.: 13/028,763

(22) Filed: Feb. 16, 2011

(65) Prior Publication Data

US 2011/0217886 A1 Sep. 8, 2011

(30) Foreign Application Priority Data

Mar. 5, 2010 (JP) ..... 2010-049671
Mar. 5, 2010 (JP) ..... 2010-049672

(51) Int. Cl.
*B63H 21/21* (2006.01)
*B63H 23/00* (2006.01)

(52) U.S. Cl.
USPC ..... 440/1; 440/86

(58) Field of Classification Search
USPC ..... 440/1, 2, 53, 61 R, 61 T, 61 G, 84, 440/86, 87; 114/144 A, 144 RE; 701/21
See application file for complete search history.

(56) References Cited

U.S. PATENT DOCUMENTS

| | | | | |
|---|---|---|---|---|
| 7,238,071 | B2 * | 7/2007 | Takada et al. | 440/84 |
| 7,702,431 | B2 * | 4/2010 | Kaji | 701/21 |
| 2003/0054704 | A1 | 3/2003 | Kanno | |
| 2003/0109184 | A1 | 6/2003 | Kanno | |
| 2009/0209151 | A1 | 8/2009 | Suzuki et al. | |
| 2009/0221193 | A1 | 9/2009 | Suzuki et al. | |

FOREIGN PATENT DOCUMENTS

JP 2009-190671 A 8/2009

* cited by examiner

*Primary Examiner* — Lars A Olson
*Assistant Examiner* — Anthony Wiest
(74) *Attorney, Agent, or Firm* — Carrier Blackman & Associates, P.C.; Joseph P. Carrier; William D. Blackman

(57) ABSTRACT

In an apparatus for controlling operation of an outboard motor having an internal combustion engine, a transmission, and a trim angle regulation mechanism, where operation of the transmission is controlled to change the gear position from a second speed to a first speed when detected throttle change amount not less than a first predetermined value and operation of the trim angle regulation mechanism is controlled to start the trim-up operation such that the trim angle converges to a predetermined angle, the operation of the trim angle regulation mechanism is controlled such that the trim angle is decreased based on the detected rudder angle when steering of the outboard motor is started, thereby enabling to appropriately prevent cavitation caused by steering of the outboard motor, so that the boat can be smoothly turned.

18 Claims, 19 Drawing Sheets

TRIM-UP OPERATION STARTED

TRIM-UP OPERATION STOPPED

TRIM-DOWN

OUTBOARD MOTOR CONTROL APPARATUS

BACKGROUND OF THE INVENTION

1. Field of the Invention

This invention relates to an outboard motor control apparatus, particularly to an apparatus for controlling an outboard motor with a transmission.

2. Description of the Related Art

In recent years, there is proposed an outboard motor having a transmission interposed at a power transmission shaft between an internal combustion engine and a propeller to change an output of the engine in speed and transmit it to the propeller, as taught, for example, by Japanese Laid-Open Patent Application No. 2009-190671. In the reference, when a throttle lever is manipulated by the operator to accelerate the boat speed, a gear position (ratio) of the transmission is changed from the second speed to the first speed to amplify torque to be transmitted to the propeller, thereby improving the acceleration performance. After that, when the engine speed is increased and the acceleration is completed, the transmission is changed back from the first speed to the second speed. There is also known an outboard motor having, in addition to the transmission, a trim angle regulation mechanism for regulating a trim angle relative to the boat.

SUMMARY OF THE INVENTION

When the transmission is changed back from the first speed to the second speed as mentioned above, in order to make the boat speed reach the maximum speed, it is assumed that the trim angle regulation mechanism is operated to conduct the trim-up operation to regulate the trim angle to a predetermined angle. However, if the outboard motor is steered upon the manipulation of a steering wheel by the operator when the trim angle is regulated at the predetermined angle and the boat cruises at the maximum speed, cavitation may occur depending on degree of the steering. In that case, it could adversely affect the smooth turn of the boat.

An object of this invention is therefore to overcome the foregoing drawbacks by providing an apparatus for controlling an outboard motor having a transmission and a trim angle regulation mechanism for regulating the trim angle, which apparatus can appropriately prevent cavitation caused by steering of the outboard motor, so that the boat can be smoothly turned.

In order to achieve the object, this invention provides in a first aspect an apparatus for controlling operation of an outboard motor adapted to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed and transmitting power of the engine to the propeller with a gear ratio determined by established speed, and a trim angle regulation mechanism regulating a trim angle relative to the boat through trim-up/down operation, comprising: a throttle opening change amount detector that detects a change amount of throttle opening of the engine; an engine speed detector that detects speed of the engine; a rudder angle detector that detects a rudder angle of the outboard motor relative to the boat; a transmission controller that controls operation of the transmission to change the gear position from the second speed to the first speed when the second speed is selected and the detected change amount of the throttle opening is equal to or greater than a first predetermined value; and a trim angle controller that controls operation of the trim angle regulation mechanism to start the trim-up operation such that the trim angle converges to a predetermined angle when the detected engine speed is equal to or greater than a predetermined speed, wherein the trim angle controller controls the operation of the trim angle regulation mechanism such that the trim angle is decreased based on the detected rudder angle when steering of the outboard motor is started.

In order to achieve the object, this invention provides in a second aspect a method for controlling operation of an outboard motor adapted to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed and transmitting power of the engine to the propeller with a gear ratio determined by established speed, and a trim angle regulation mechanism regulating a trim angle relative to the boat through trim-up/down operation, comprising the steps of: detecting a change amount of throttle opening of the engine; detecting speed of the engine; detecting a rudder angle of the outboard motor relative to the boat; controlling operation of the transmission to change the gear position from the second speed to the first speed when the second speed is selected and the detected change amount of the throttle opening is equal to or greater than a first predetermined value; and controlling operation of the trim angle regulation mechanism to start the trim-up operation such that the trim angle converges to a predetermined angle when the detected engine speed is equal to or greater than a predetermined speed, wherein the step of trim angle controlling controls the operation of the trim angle regulation mechanism such that the trim angle is decreased based on the detected rudder angle when steering of the outboard motor is started.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

Preferred embodiments of an outboard motor control apparatus according to the invention will now be explained with reference to the attached drawings.

Figure 1:
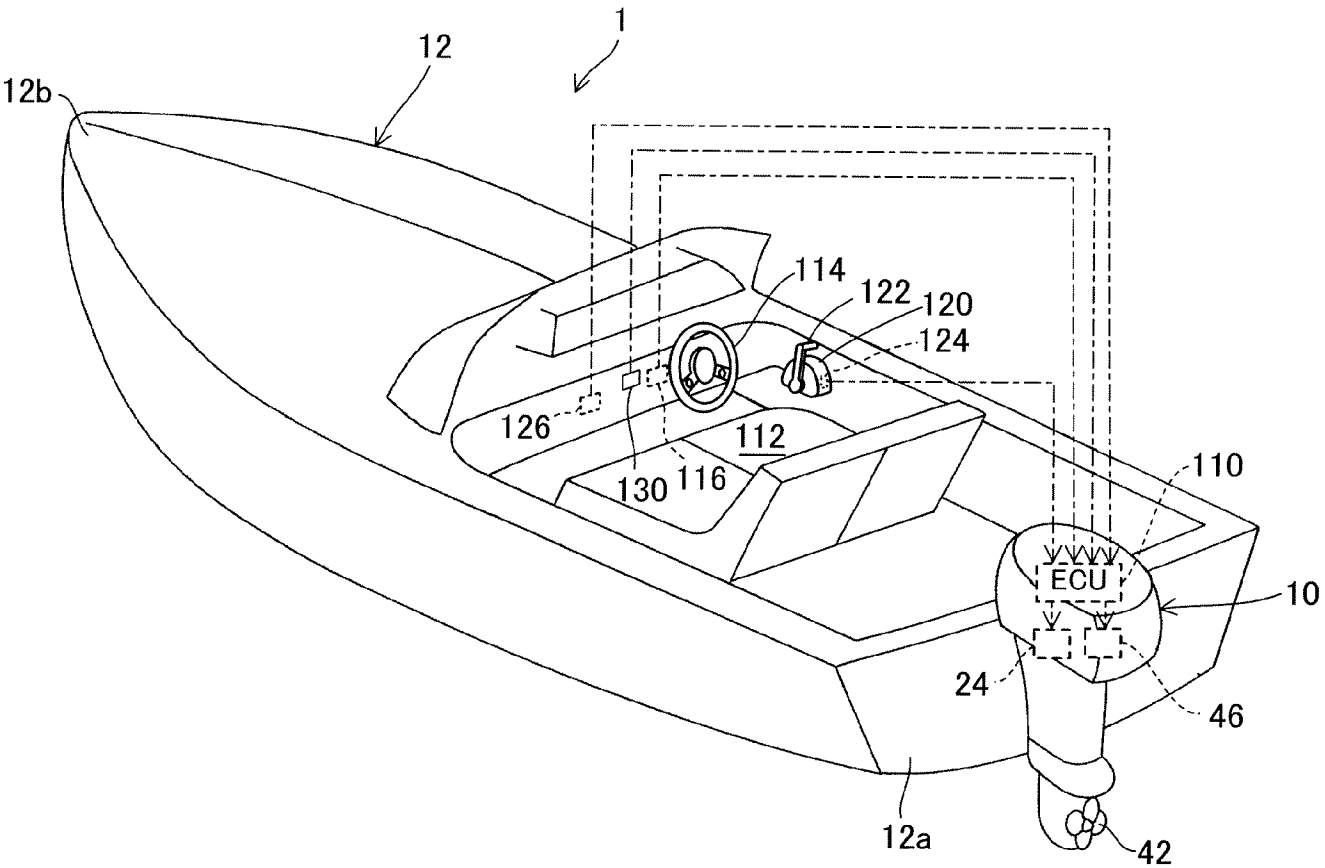
FIG. 1 is an overall schematic view of an outboard motor control apparatus including a boat according to a first embodiment of the invention.
Figure 2:
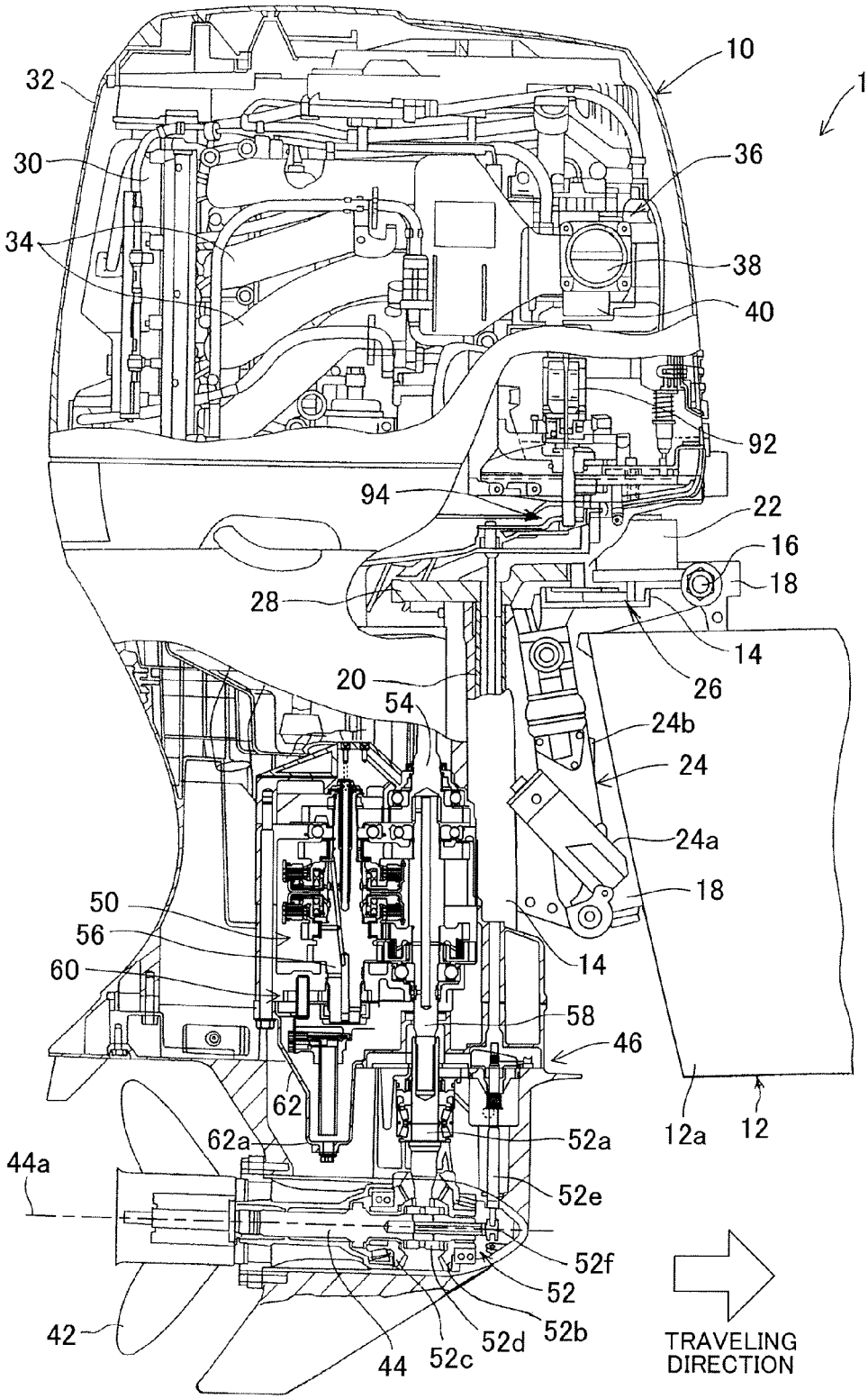
FIG. 2 is an enlarged sectional side view partially showing the outboard motor shown in FIG. 1.

FIG. 1 is an overall schematic view of an outboard motor control apparatus including a boat according to a first embodiment of the invention. FIG. 2 is an enlarged sectional side view partially showing the outboard motor shown in FIG. 1 and FIG. 3 is an enlarged side view of the outboard motor.

Figure 3:
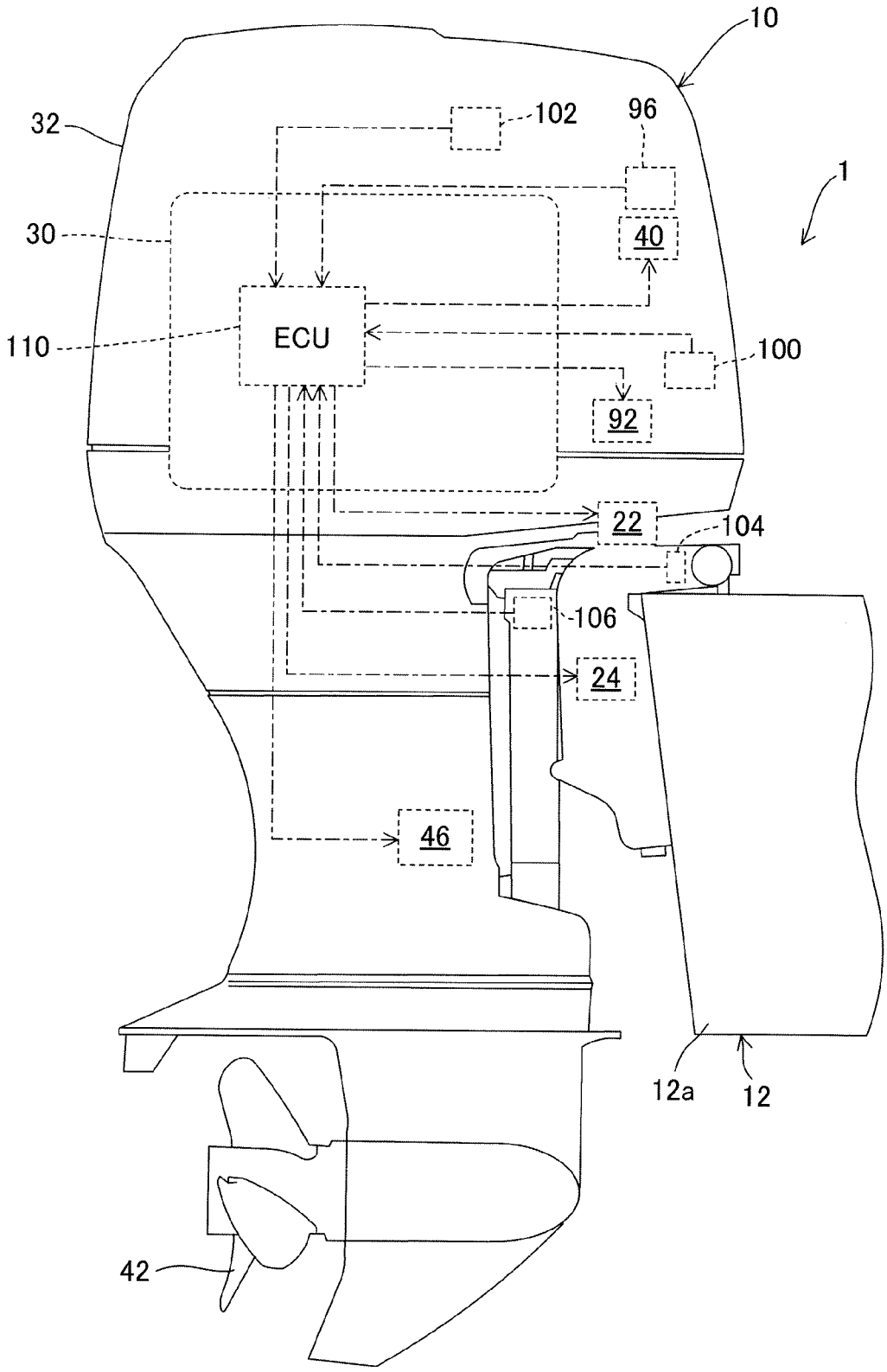
FIG. 3 is an enlarged side view of the outboard motor shown in FIG. 1.

In FIGS. 1 to 3, a symbol 1 indicates a boat or vessel whose hull 12 is mounted with an outboard motor 10. As clearly shown in FIG. 2, the outboard motor 10 is clamped (fastened) to the stern or transom 12*a* of the boat 1, more precisely, to the stern 12*a* of the hull 12 through a swivel case 14, tilting shaft 16 and stern brackets 18.

An electric steering motor (actuator) 22 for operating a shaft 20 which is housed in the swivel case 14 to be rotatable about the vertical axis and a power tilt-trim unit (trim angle regulation mechanism; hereinafter called the "trim unit") 24 for regulating a tilt angle and trim angle of the outboard motor 10 relative to the boat 1 (i.e., hull 12) by tilting up/down and trimming up/down are installed near the swivel case 14. A rotational output of the steering motor 22 is transmitted to the shaft 20 via a speed reduction gear mechanism 26 and a mount frame 28, whereby the outboard motor 10 is steered about the shaft 20 as a steering axis to the right and left directions (steered about the vertical axis). The maximum steering angle of the outboard motor 10 is set to 50 degrees to the right and left directions.

The trim unit 24 integrally comprises a hydraulic cylinder 24*a* for adjusting the tilt angle, a hydraulic cylinder 24*b* for adjusting the trim angle. In the trim unit 24, the hydraulic cylinders 24*a*, 24*b* are extended/contracted so that the swivel case 14 is rotated about the tilting shaft 16 as a rotational axis, thereby tiling up/down and trimming up/down the outboard motor 10. The hydraulic cylinders 24*a*, 24*b* are connected to a hydraulic circuit (not shown) in the outboard motor 10 and extended/contracted upon being supplied with operating oil therethrough.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An air intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30 to control an engine speed NE of the engine 30.

The outboard motor 10 further comprises a propeller shaft (power transmission shaft) 44 that is supported to be rotatable about the horizontal axis and attached with a propeller 42 at its one end to transmit power output of the engine 30 thereto, and a transmission (automatic transmission) 46 that is interposed at a location between the engine 30 and propeller shaft 44 and has a plurality of gear positions, i.e., first, second and third speeds.

The propeller shaft 44 is positioned so that its axis line 44*a* is substantially parallel to the traveling direction of the boat 1 in the initial condition of the trim unit 24 (condition where the trim angle θ is at the initial angle). The transmission 46 comprises a transmission mechanism 50 that is selectively changeable in gear positions and a shift mechanism 52 that can change a shift position among forward, reverse and neutral positions.

Figure 4:
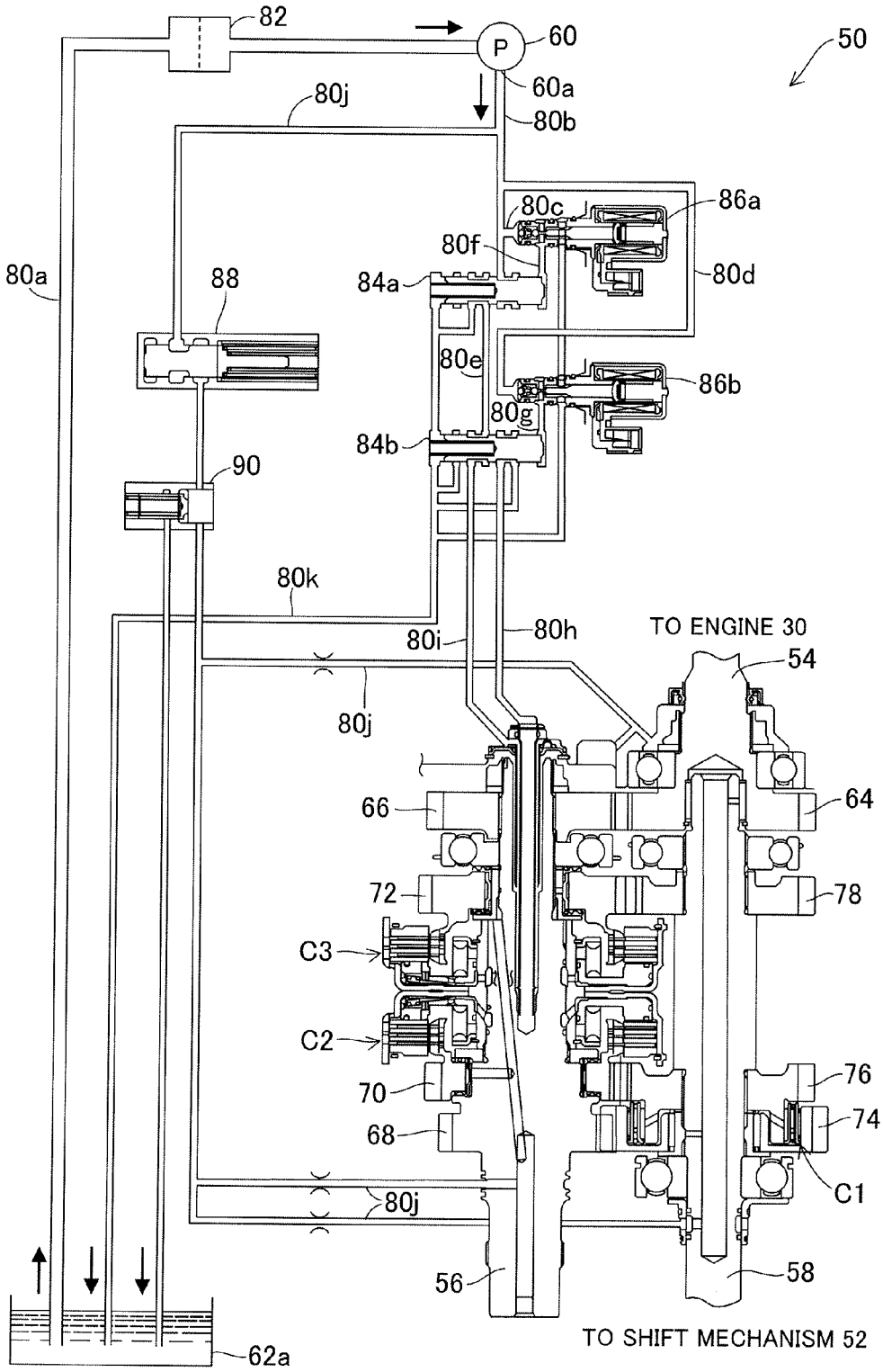
FIG. 4 is a hydraulic circuit diagram schematically showing a hydraulic circuit of a transmission mechanism shown in FIG. 2.

FIG. 4 is a hydraulic circuit diagram schematically showing a hydraulic circuit of the transmission mechanism 50.

As shown in FIGS. 2 and 4, the transmission mechanism 50 comprises a parallel-axis type transmission mechanism with distinct gear positions (ratios), which includes an input shaft (drive shaft) 54 connected to the crankshaft (not shown in the figures) of the engine 30, a countershaft 56 connected to the input shaft 54 through a gear, and a first connecting shaft 58 connected to the countershaft 56 through several gears. Those shafts 54, 56, 58 are installed in parallel. Thus, the transmission 46 is interposed at a location between the input shaft (drive shaft) 54 and propeller shaft 44

The countershaft 56 is connected with a hydraulic pump (gear pump; shown in FIGS. 2 and 4) 60 that pumps up the operating oil (lubricating oil) and forwards it to transmission clutches and lubricated portions of the transmission mechanism 50 (explained later). The foregoing shafts 54, 56, 58, hydraulic pump 60 and the like are housed in a case 62 (shown only in FIG. 2). An oil pan 62*a* for receiving the operating oil is formed at the bottom of the case 62. In the so-configured transmission mechanism 50, the gear installed on the shaft to be rotatable relative thereto is fixed on the shaft through the transmission clutch so that the transmission 46 is selectively changeable in the gear position to establish one of the three speeds (i.e., first to third speeds), and the output of the engine 30 is changed with the gear ratio determined by the established (selected) gear position (speed; gear) and transmitted to the propeller 42 through the shift mechanism 52 and propeller shaft 44. A gear ratio of the gear position (speed) is set to be the highest in the first speed and decreases as the speed changes to second and then third speed.

The further explanation on the transmission mechanism 50 will be made. As clearly shown in FIG. 4, the input shaft 54 is supported with an input primary gear 64. The countershaft 56 is supported with a counter primary gear 66 to be meshed with the input primary gear 64, and also supported with a counter first-speed gear 68, counter second-speed gear 70 and counter third-speed gear 72.

The first connecting shaft 58 is supported with an output first-speed gear 74 to be meshed with the counter first-speed gear 68, an output second-speed gear 76 to be meshed with the counter second-speed gear 70, and an output third-speed gear 78 to be meshed with the counter third-speed gear 72.

In the above configuration, when the output first-speed gear 74 supported to be rotatable relative to the first connecting shaft 58 is brought into a connection with the first connecting shaft 58 through a first-speed clutch C1, the first speed (gear position) is established. The first-speed clutch C1 comprises a one-way clutch. When a second-speed or third-speed hydraulic clutch C2 or C3 (explained later) is supplied with hydraulic pressure so that the second or third speed (gear position) is established and the rotational speed of the first connecting shaft 58 becomes greater than that of the output first-speed gear 74, the first-speed clutch C1 makes the output first-speed gear 74 rotate idly (i.e., rotate without being meshed).

When the counter second-speed gear 70 supported to be rotatable relative to the countershaft 56 is brought into a connection with the countershaft 56 through the second-speed hydraulic clutch (transmission clutch) C2, the second speed (gear position) is established. Further, when the counter third-speed gear 72 supported to be rotatable relative to the countershaft 56 is brought into a connection with the countershaft 56 through the third-speed hydraulic clutch (transmission clutch) C3, the third speed (gear position) is established. The hydraulic clutches C2, C3 connect the gears 70, 72 to the countershaft 56 upon being supplied with the operating oil, while making the gears 70, 72 rotate idly when the operating oil is not supplied.

The interconnections between the gears and shafts through the clutches C1, C2, C3 are performed by controlling hydraulic pressure supplied from the pump 60 to the hydraulic clutches C2, C3.

The further explanation will be made with reference to FIG. 4. When the oil pump 60 is driven by the engine 30, it pumps up the operating oil in the oil pan 62*a* through an oil passage 80*a* and strainer 82 and forwards it from a discharge port 60*a* to a first switching valve 84*a* through an oil passage 80*b* and to first and second electromagnetic solenoid valves (linear solenoid valves) 86*a*, 86*b* through oil passages 80*c*, 80*d*.

The first switching valve 84*a* is connected to the second switching valve 84*b* through an oil passage 80*e*. Each of the valves 84*a*, 84*b* has a movable spool installed therein and the spool is urged by a spring at its one end (left end in the drawing) toward the other end. The valves 84*a*, 84*b* are connected on the sides of the other ends of the spools with the first and second solenoid valves 86*a*, 86*b* through oil passages 80*f*, 80*g*, respectively.

Upon being supplied with current (i.e., made ON), a spool housed in the first solenoid valve 86*a* is displaced to output the hydraulic pressure supplied from the pump 60 through the oil passage 80*c* to the other end side of the spool of the first switching valve 84*a*. Accordingly, the spool of the first switching valve 84*a* is displaced to its one end side, thereby forwarding the operating oil in the oil passage 80*b* to the oil passage 80*e*.

Similarly to the first solenoid valve 86*a*, upon being supplied with current (i.e., made ON), a spool of the second solenoid valve 86*b* is displaced to output the hydraulic pressure supplied from the pump 60 through the oil passage 80*d* to the other end side of the spool of the second switching valve 84*b*. Accordingly, the spool of the second switching valve 84*b* is displaced to its one end side, thereby forwarding the operating oil in the oil passage 80*e* to the second-speed hydraulic clutch C2 through the oil passage 80*h*. In contrast, when the second solenoid valve 86*b* is not supplied with current (made OFF) and no hydraulic pressure is outputted to the other end side of the second switching valve 84*b*, the operating oil in the oil passage 80*e* is forwarded to the third-speed hydraulic clutch C3 through the oil passage 80*i*.

When the first and second solenoid valves 86*a*, 86*b* are both made OFF, the hydraulic pressure is not supplied to the hydraulic clutches C2, C3 and hence, the output first-speed gear 74 and first connecting shaft 58 are interconnected through the first-speed clutch C1 so that the first speed is established. When the first and second solenoid valves 86*a*, 86*b* are both made ON, the hydraulic pressure is supplied to the second-speed hydraulic clutch C2 and accordingly, the counter second-speed gear 70 and countershaft 56 are interconnected so that the second speed is established. Further, when the first solenoid valve 86*a* is made ON and the second solenoid valve 86*b* is made OFF, the hydraulic pressure is supplied to the third-speed hydraulic clutch C3 and accordingly, the counter third-speed gear 72 and countershaft 56 are interconnected so that the third speed is established.

Thus, one of the gear positions of the transmission 46 is selected (i.e., transmission control is conducted) by controlling ON/OFF of the first and second switching valves 84*a*, 84*b*.

Note that the operating oil (lubricating oil) from the hydraulic pump 60 is also supplied to the lubricated portions (e.g., the shafts 54, 56, 58, etc.) of the transmission 46 through the oil passage 80*b*, an oil passage 80*j*, a regulator valve 88 and a relief valve 90. Also, the first and second switching valves 84*a*, 84*b* and the first and second solenoid valves 86*a*, 86*b* are connected with an oil passage 80*k* adapted to relieve pressure.

The explanation on FIG. 2 is resumed. The shift mechanism 52 comprises a second connecting shaft 52*a* that is connected to the first connecting shaft 58 of the transmission mechanism 50 and installed parallel to the vertical axis to be rotatably supported, a forward bevel gear 52*b* and reverse bevel gear 52*c* that are connected to the second connecting shaft 52*a* to be rotated, a clutch 52*d* that can engage the propeller shaft 44 with either one of the forward bevel gear 52*b* and reverse bevel gear 52*c*, and other components.

The interior of the engine cover 32 is disposed with an electric shift motor (actuator) 92 that drives the shift mechanism 52. The output shaft of the shift motor 92 can be connected via a speed reduction gear mechanism 94 with the upper end of a shift rod 52*e* of the shift mechanism 52. When the shift motor 92 is operated, its output appropriately displaces the shift rod 52*e* and a shift slider 52*f* to move the clutch 52*d* to change the shift position among the forward, reverse and neutral positions.

When the shift position is forward or reverse, the rotational output of the first connecting shaft 58 is transmitted via the shift mechanism 52 to the propeller shaft 44 to rotate the propeller 42 in one of the directions making the boat 1 move forward or rearward. The outboard motor 10 is equipped with a power source (not shown) such as a battery or the like attached to the engine 30 to supply operating power to the motors 22, 40, 92, etc.

As shown in FIG. 3, a throttle opening sensor (throttle opening change amount detector) 96 is installed near the throttle valve 38 and produces an output or signal indicative of opening of the throttle valve 38, i.e., throttle opening TH. A neutral switch 100 is installed near the shift rod 52*e* and produces an ON signal when the shift position of the transmission 46 is neutral and an OFF signal when it is forward or reverse. A crank angle sensor (engine speed detector) 102 is installed near the crankshaft of the engine 30 and produces a pulse signal at every predetermined crank angle.

A trim angle sensor 104 is installed near the tilting shaft 16 and produces an output or signal corresponding to a trim angle θ of the outboard motor 10 (i.e., a rotation angle of the outboard motor 10 about its pitching axis relative to the hull 12). A rudder angle sensor (rudder angle detector) 106 installed near the shaft 20 produces an output or signal indicative of a rotation angle of the shaft 20, i.e., a rudder angle α of the outboard motor 10 relative to the boat (i.e., hull 12).

The rudder angle sensor 106 produces a signal indicating 0 degree when the outboard motor 10 is at an angle (position) relative to the hull 12 at which the boat 1 cruises straight. When the outboard motor 10 is steered to the right or left direction, the sensor 106 produces a positive value corresponding to the rotation angle of the shaft 20 in the clockwise case and a negative value in the counterclockwise case.

The sensors 104, 106 comprise rotation angle sensors such as rotary encoders.

The outputs of the foregoing sensors and switch are sent to an Electronic Control Unit (ECU) 110 disposed in the outboard motor 10. The ECU 110 which has a microcomputer comprising a CPU, ROM, RAM and other devices is installed in the engine cover 32 of the outboard motor 10.

As shown in FIG. 1, a steering wheel 114 is installed near a cockpit (the operator's seat) 112 of the hull 12 to be manipulated or rotated by the operator (not shown). The steering wheel 114 can be rotated to the right and left directions from the initial position (at which the boat 1 cruises straight). A steering angle sensor 116 attached on a shaft (not shown) of the steering wheel 114 produces an output or signal corresponding to the steering angle applied or inputted by the operator through the steering wheel 114.

A remote control box 120 provided near the cockpit 112 is equipped with a shift/throttle lever (throttle lever) 122 installed to be manipulated by the operator. The lever 122 can be moved or swung in the front-back direction from the initial position and is used by the operator to input a forward/reverse change command and an engine speed regulation command (i.e., a desired engine speed NEa) including an acceleration/deceleration command or instruction for the engine 30. A lever position sensor 124 is installed in the remote control box 120 and produces an output or signal corresponding to a position of the lever 122.

An acceleration sensor 126 for detecting acceleration acting on the hull 12 is disposed near the cockpit 112 and in the center of gravity of the hull 12. The acceleration sensor 126 produces an output or signal indicative of acceleration acting on the hull 12 in its vertical (gravitational) direction, etc.

A switch 130 is also provided near the cockpit 112 to be manually operated by the operator to input a fuel consumption decreasing command for decreasing fuel consumption of the engine 30. The switch 130 is manipulated or pressed when the operator desires to travel the boat 1 with high fuel efficiency, and upon the manipulation, it produces a signal (ON signal) indicative of the fuel consumption decreasing command. The outputs of the sensors 116, 124, 126 and switch 130 are also sent to the ECU 110.

Based on the inputted outputs, the ECU 110 controls the operation of the motors 22, 92, while performing the transmission control of the transmission 46 and the trim angle control for regulating the trim angle θ through the trim unit 24. Further, based on the engine speed NE and throttle opening TH, the ECU 110 controls the operation of the throttle motor 40 so that the engine speed NE becomes the desired engine speed NEa.

Thus, the outboard motor control apparatus according to the embodiments is a Drive-By-Wire type apparatus whose operation system (steering wheel 114, lever 122) has no mechanical connection with the outboard motor 10.

Figure 5:
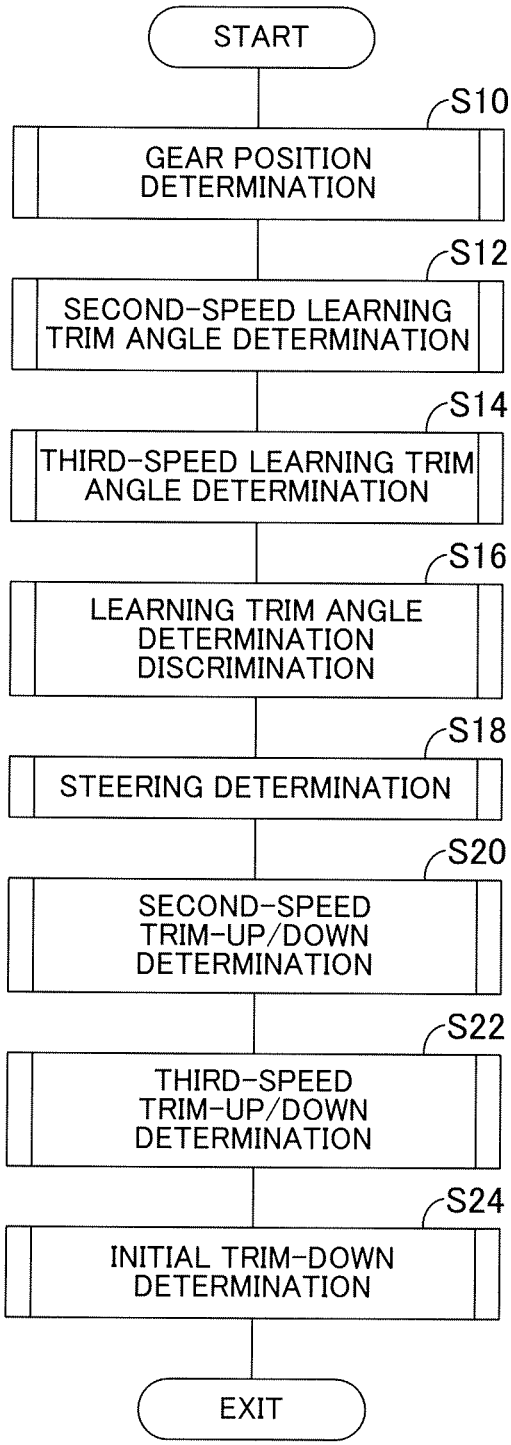
FIG. 5 is a flowchart showing transmission control operation and trim angle control operation by an electronic control unit shown in FIG. 1.

FIG. 5 is a flowchart showing the transmission control operation and trim angle control operation by the ECU 110. The illustrated program is executed by the ECU 110 at predetermined intervals, e.g., 100 milliseconds.

The program begins at S10, in which the operation for determining which gear position of the transmission 46 from among the first to third speeds is to be selected, is conducted.

Figure 6:
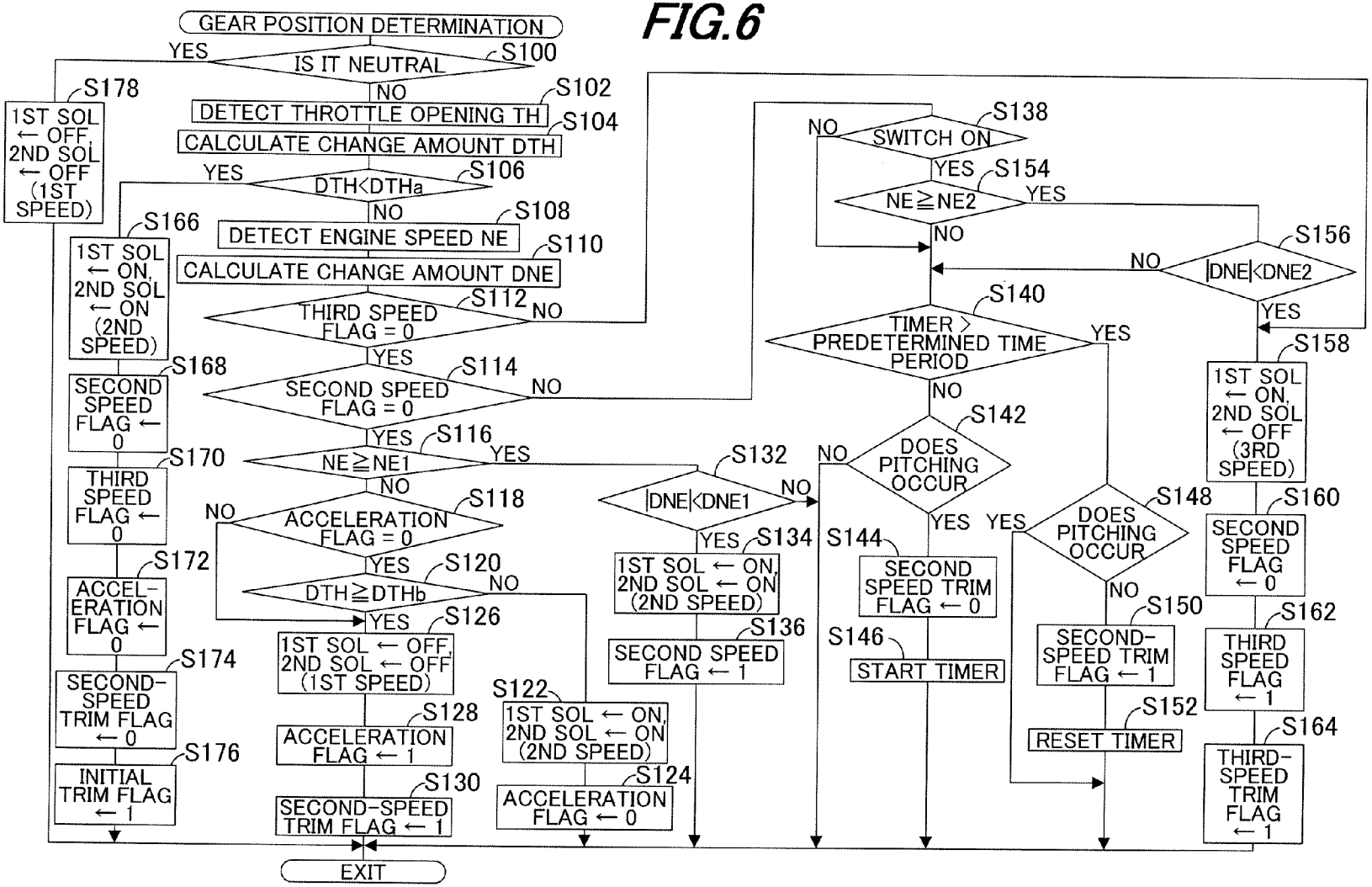
FIG. 6 is a subroutine flowchart showing the operation of gear position determination of the FIG. 5 flowchart.

FIG. 6 is a subroutine flowchart showing the operation of gear position determination.

In S100, it is determined whether the shift position of the transmission 46 is neutral. This determination is made by checking as to whether the neutral switch 100 outputs the ON signal. When the result in S100 is negative, i.e., it is determined to be in gear, the program proceeds to S102, in which the throttle opening TH is detected or calculated from the output of the throttle opening sensor 96, and to S104, in which a change amount (variation) DTH of the detected throttle opening TH per unit time (e.g., 500 milliseconds) is detected or calculated.

The program proceeds to S106, in which it is determined whether the deceleration is instructed to the engine 30 by the operator, i.e., whether the engine 30 is in the operating condition to decelerate the boat 1. This determination is made by checking as to whether the throttle valve 38 is operated in the closing direction. More specifically, it is determined that the valve 38 is operated in the closing direction (the deceleration is instructed) when the change amount DTH is less than a deceleration-determining predetermined value (second predetermined value) DTHa set to a negative value (e.g., −0.5 degree).

When the result in S106 is negative, the program proceeds to S108, in which the engine speed NE is detected or calculated from the output of the crank angle sensor 102, and to S110, in which a change amount (variation) DNE of the engine speed NE is detected or calculated. The change amount DNE is obtained by subtracting the engine speed NE detected in the present program loop from that detected in the previous program loop.

Next, the program proceeds to S112, in which it is determined whether the bit of an after-acceleration third-speed changed flag (hereinafter called the "third speed flag") which indicates that the gear position is changed to the third speed after the acceleration is completed, is θ. Since the initial value of this flag is θ, the result in S112 in the first program loop is generally affirmative and the program proceeds to S114.

In S114, it is determined whether the bit of an after-acceleration second-speed changed flag (hereinafter called the "second speed flag") is 0. The bit of this flag is set to 1 when the gear position is changed from the first speed to the second speed after the acceleration is completed, and otherwise, reset to 0.

Since the initial value of the second speed flag is also 0, the result in S114 in the first program loop is generally affirmative and the program proceeds to S116, in which it is determined whether the engine speed NE is equal to or greater than a first predetermined speed NE1. The first predetermined speed NE1 will be explained later.

Since the engine speed NE is less than the first predetermined speed NE1 generally in a program loop immediately after the engine start, the result in S116 is negative and the program proceeds to S118, in which it is determined whether the bit of an acceleration determining flag (explained later; indicated by "acceleration flag" in the drawing) is 0. Since the initial value of this flag is also 0, the result in 5118 in the first program loop is generally affirmative and the program proceeds to S120.

In S120, it is determined whether the acceleration (precisely, the rapid acceleration) is instructed to the engine 30 by the operator, i.e., whether the engine 30 is in the operating condition to accelerate the boat 1 (rapidly). This determination is made by checking as to whether the throttle valve 38 is operated in the opening direction rapidly.

Specifically, the change amount DTH of the throttle opening TH detected in S104 is compared with an acceleration-determining predetermined value (first predetermined value) DTHb and when the change amount DTH is equal to or greater than the predetermined value DTHb, it is determined that the throttle valve 38 is operated in the opening direction rapidly, i.e., the acceleration is instructed. The predetermined value DTHb is set to a value (positive value, e.g., 0.5 degree) greater than the deceleration-determining predetermined value DTHa, as a criterion for determining whether the acceleration is instructed to the engine 30.

When the result in S120 is negative, i.e., it is determined that neither the acceleration nor the deceleration is instructed to the engine 30, the program proceeds to S122, in which the first and second solenoid valves 86*a*, 86*b* (indicated by "1ST SOL," "2ND SOL" in the drawing) are both made ON to select the second speed in the transmission 46, and to S124, in which the bit of the acceleration determining flag is reset to 0.

On the other hand, when the result in S120 is affirmative, the program proceeds to S126, in which the first and second solenoid valves 86*a*, 86*b* are both made OFF to change the gear position (shift down the gear) of the transmission 46 from the second speed to the first speed. As a result, the output torque of the engine 30 is amplified through the transmission 46 (more precisely, the transmission mechanism 50) which has been shifted down to the first speed, and transmitted to the propeller 42 via the propeller shaft 44, thereby improving the acceleration performance.

Then the program proceeds to S128, in which the bit of the acceleration determining flag is set to 1. Specifically, the bit of this flag is set to 1 when the change amount DTH is equal to or greater than the predetermined value DTHb and the transmission 46 is changed from the second speed to the first speed, and otherwise, reset to 0. Upon setting of the bit of the acceleration determining flag to 1, the result in S118 in the next and subsequent loops becomes negative and the program skips the process of S120.

Thus, since the transmission 46 is set in the second speed during a period from when the engine 30 is started until the acceleration is instructed (i.e., during the normal operation), it becomes possible to ensure the usability of the outboard motor 10 similarly to that of an outboard motor having no transmission.

Next, the program proceeds to S130, in which the bit of a second-speed trim flag (initial value 0) is set to 1 and the program is terminated. Specifically, the bit of this flag being set to 1 means that the change amount DTH is equal to or greater than the predetermined value DTHb, the transmission 46 is changed to the first speed, and the trim-up operation is to be conducted in the operation of second-speed trim-up determination (explained later), while being reset to 0 means that the trim-up operation is not needed, i.e., for example, the deceleration is instructed to the engine 30.

After the transmission 46 is changed to the first speed, when the engine speed NE is gradually increased and the acceleration through the torque amplification in the first speed is completed (i.e., the acceleration range is saturated), the engine speed NE reaches the first predetermined speed (predetermined speed) NE1. Subsequently, in the next program loop, the result in S116 becomes affirmative and the program proceeds to S132 onward. The first predetermined speed NE1 is set to a relatively high value (e.g., 6000 rpm) as a criterion for determining whether the acceleration in the first speed is completed.

In S132, it is determined whether the engine speed NE is stable, i.e., the engine 30 is stably operated. This determination is made by comparing an absolute value of the change amount DNE of the engine speed NE with a first prescribed value DNE1. When the absolute value is less than the first prescribed value DNE1, the engine speed NE is determined to be stable. The first prescribed value DNE1 is set as a criterion (e.g., 500 rpm) for determining whether the engine speed NE is stable, i.e., the change amount DNE is relatively small.

When the result in S132 is negative, the program is terminated with the first speed being maintained, and when the result is affirmative, the program proceeds to S134, in which the first and second solenoid valves 86*a*, 86*b* are both made ON to change the transmission 46 (shift up the gear) from the first speed to the second speed, and to S136, in which the bit of the second speed flag is set to 1. It causes the increase in the rotational speed of the second connecting shaft 52*a* and that of the propeller shaft 44, so that the boat speed is increased, thereby improving the speed performance.

Upon setting of the bit of the second speed flag to 1 in S136, the result in S114 in the next and subsequent loops becomes negative and the program proceeds to S138. Thus, when the bit of the second speed flag is set to 1, i.e., when the gear position is changed to the second speed after the acceleration in the first speed is completed, the process of S138 onward is conducted.

In S138, it is determined whether the switch 130 outputs the ON signal, i.e., whether the fuel consumption decreasing command for the engine 30 is inputted by the operator. When the result in S138 is negative, the program proceeds to S140, in which it is determined whether a value of a trim-up restart timer (described later) exceeds a value indicating a predetermined time period. Since the initial value of the timer is 0, the result here is negative and the program proceeds to S142, in which it is determined whether the pitching (vibration or shake in the vertical direction) of the hull 12 occurs.

The pitching occurrence is determined based on the output of the acceleration sensor 126, specifically, it is determined by detecting or calculating vibration acceleration Gz acting on the hull 12 in the vertical direction based on the output of the acceleration sensor 126, and determining whether an absolute value of the vibration acceleration Gz is within a permissible range. When the vibration acceleration Gz is determined to be out of the permissible range multiple (e.g., two) times sequentially, the pitching is determined to occur. The permissible range is set to a range (e.g., 0 to 0.5 G) as a criterion for determining whether the vertical vibration of the hull 12 is relatively small and no pitching occurs.

When the result in S142 is negative, the remaining steps are skipped and when the result is affirmative, the program proceeds to S144, in which the bit of the second-speed trim flag is reset to 0. Consequently, the trim-up operation is stopped through the operation of the second-speed trim-up determination which will be explained later. Then, in S146, the trim-up restart timer (up counter) is started to measure a time period since the trim-up operation is stopped.

In the next and ensuing program loops, when the result in S140 is affirmative, i.e., when the predetermined time period has elapsed since the trim-up operation stop, the program proceeds to S148, in which, similarly to S142, the pitching determination is again made. When the result in S148 is negative, the program proceeds to S150, in which the bit of the second-speed trim flag is set to 1 and to S152, in which the timer value is reset to 0.

Consequently, the trim-up operation is restarted through the operation of second-speed trim-up determination which will be explained later. The predetermined time period is set as a criterion (e.g., 5 seconds) for determining whether the trim-up operation can be restarted (because there should be no pitching anymore). When the result in S148 is affirmative, S150 and S152 are skipped.

On the other hand, when the result in S138 is affirmative, the program proceeds to S154, in which it is determined whether the engine speed NE is equal to or greater than a second predetermined speed NE2. The second predetermined speed NE2 is set to a value (e.g., 5000 rpm) slightly lower than the first predetermined speed NE1, as a criterion for determining whether it is possible to change the gear position to the third speed (explained later).

When the result in S154 is affirmative, the program proceeds to S156, in which, similarly to S132, it is determined whether the engine speed NE is stable. Specifically, the absolute value of the change amount DNE of the engine speed NE is compared with a second prescribed value DNE2 and when it is less than the second prescribed value DNE2, the engine speed NE is determined to be stable. The second prescribed value DNE2 is set as a criterion (e.g., 500 rpm) for determining whether the change amount DNE is relatively small and the engine speed NE is stable.

When the result in S156 or S154 is negative, the program proceeds to S140 mentioned above and when the result in S156 is affirmative, the program proceeds to S158, in which the first solenoid valve 86*a* is made ON and the second solenoid valve 86*b* is made OFF to change the transmission 46 (shift up the gear) from the second speed to the third speed. As a result, the engine speed NE is decreased, thereby decreasing the fuel consumption, i.e., improving the fuel efficiency.

Next, the program proceeds to S160, in which the bit of the second speed flag is reset to 0, and to S162, in which the bit of the third speed flag is set to 1. Thus, the third speed flag is set to 1 when the gear position is changed from the second speed to the third speed after the acceleration is completed, and otherwise, reset to 0.

The program proceeds to S164, in which the bit of a third-speed trim flag (initial value 0) is set to 1. The bit of this flag being set to 1 means that the gear position is changed to the third speed and the trim-down operation is to be conducted in the operation of third-speed trim-down determination (explained later), while being reset to 0 means that the trim-down operation is not needed or completed. Note that, in a program loop after the bit of the third-speed flag is set to 1 in S162, the result in S112 is negative and the process of S158 to S164 is conducted, whereafter the program is terminated with the third speed being maintained.

When the result in S106 is affirmative, i.e., when the change amount

DTH is less than the predetermined value DTHa, the program proceeds to S166, in which the first and second solenoid valves 86*a*, 86*b* are both made ON to change the transmission 46 to the second speed. Then the program proceeds to S168, S170 and S172, in which all the bits of the second speed flag, third speed flag and acceleration determining flag are reset to 0.

Then the program proceeds to S174, in which the bit of the second-speed trim flag is reset to 0 and to S176, in which the bit of an initial trim flag (initial value 0) is set to 1. The bit of the initial trim flag being set to 1 means that it is necessary to regulate the trim angle θ to the initial angle (0 degree) by operating the trim unit 24, while being reset to 0 means that it is not necessary.

When the lever 122 is manipulated by the operator to change the shift position of the transmission 46 to neutral, the result in S100 is affirmative and the program proceeds to S178, in which the first and second solenoid valves 86*a*, 86*b* are both made OFF to change the transmission 46 from the second speed to the first speed.

Returning to the explanation on the FIG. 5 flowchart, the program proceeds to S12, in which a trim angle when the gear position is in the second speed and the boat speed reaches the maximum speed is learned or stored to determine a second-speed learning trim angle (predetermined angle) δ, and to S14, in which a trim angle when the gear position is in the third speed and the boat speed reaches the maximum speed is learned or stored to determine a third-speed learning trim angle (predetermined angle) ϵ.

Figure 7:
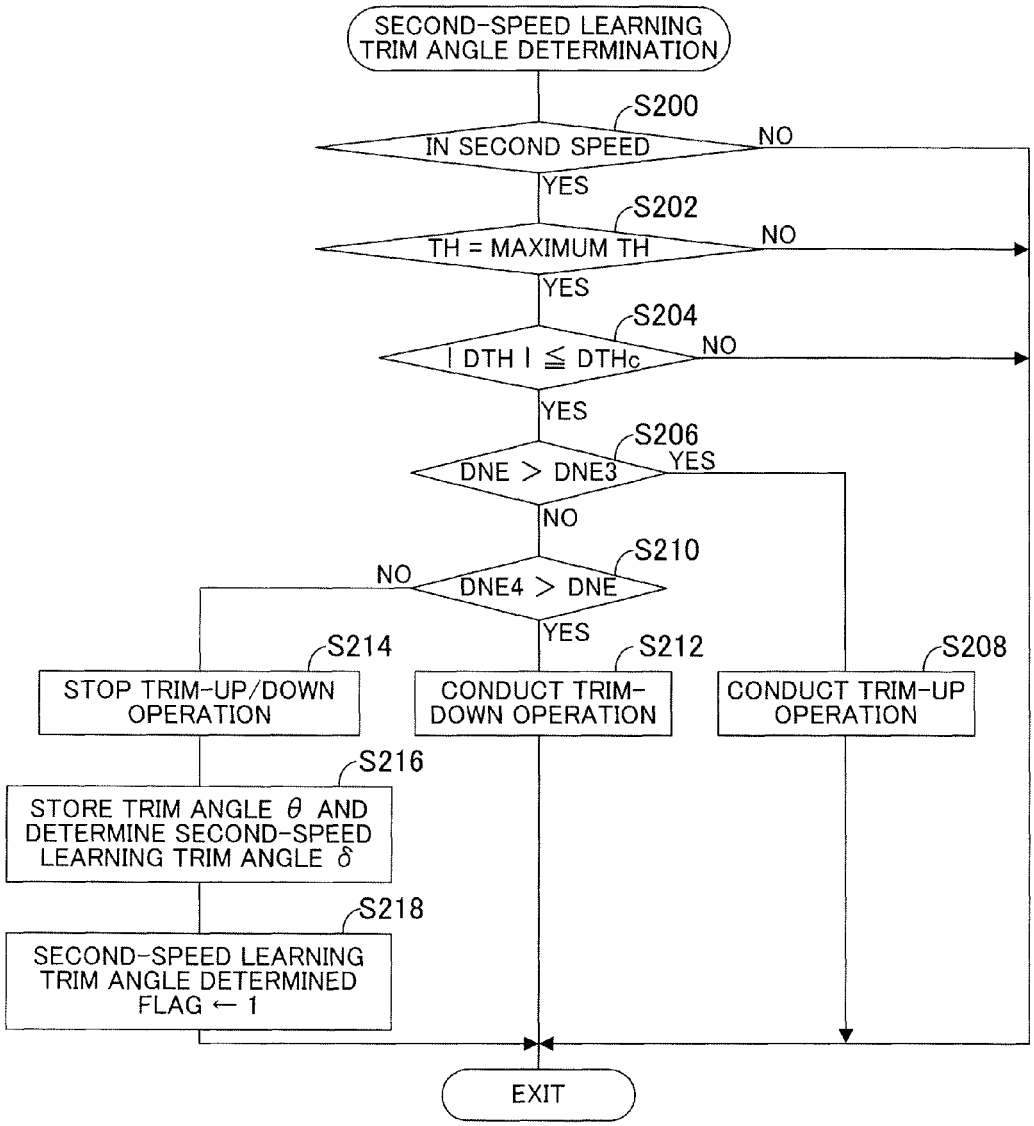
FIG. 7 is a subroutine flowchart showing the operation of second-speed learning trim angle determination of the FIG. 5 flowchart.
Figure 8:
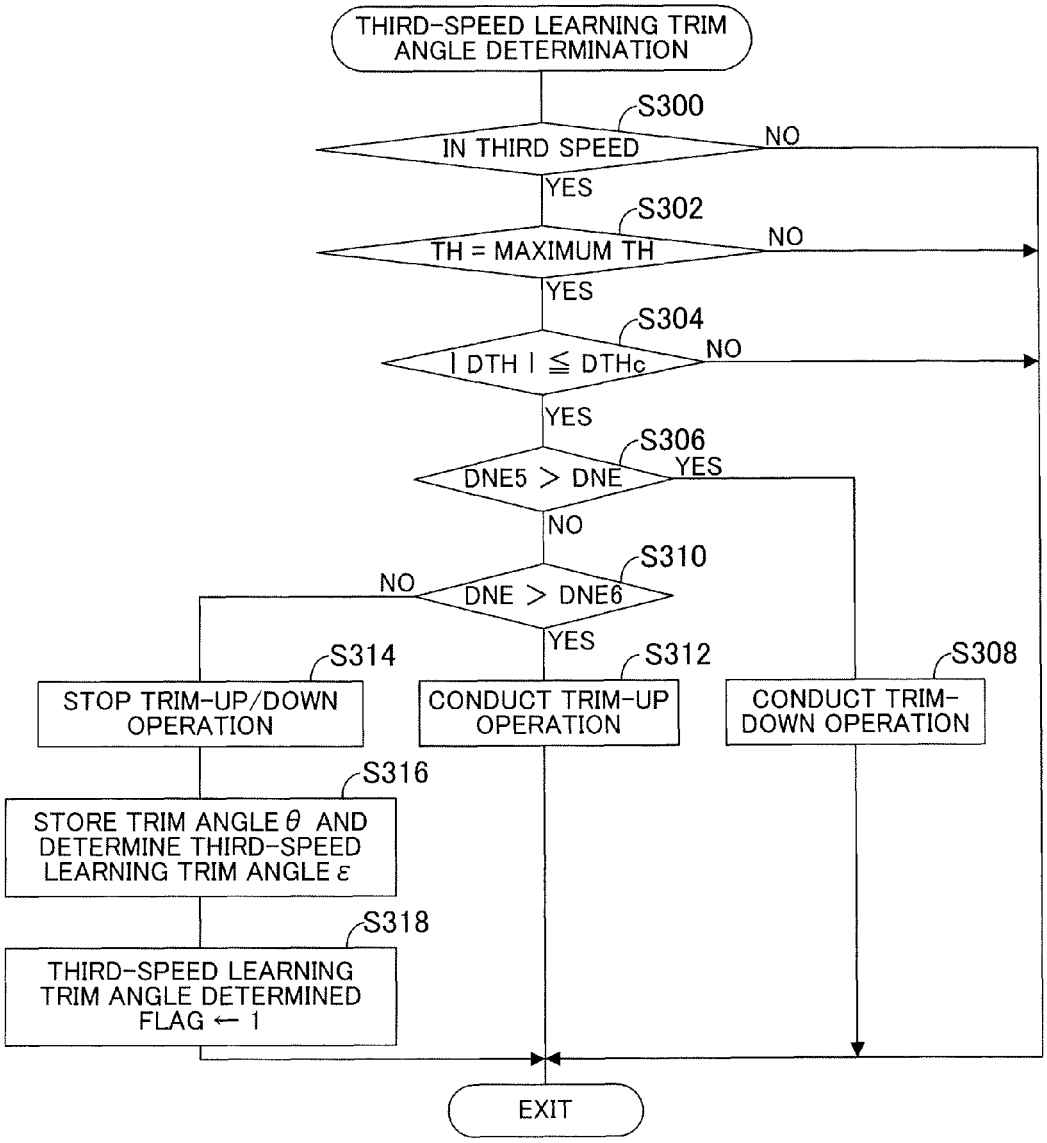
FIG. 8 is a subroutine flowchart showing the operation of third-speed learning trim angle determination of the FIG. 5 flowchart.

FIG. 7 is a subroutine flowchart showing the operation of second-speed learning trim angle determination and FIG. 8 is a subroutine flowchart showing the operation of third-speed learning trim angle determination.

As shown in FIG. 7, in S200, it is determined whether the current gear position is in the second speed. When the result in S200 is negative, the remaining steps are skipped and when the result is affirmative, the program proceeds to S202, in which it is determined whether the throttle opening TH is the maximum opening.

When the result in S202 is affirmative, the program proceeds to S204, in which it is determined whether the throttle opening TH is stable (i.e., does not vary). This determination is made by comparing an absolute value of the change amount DTH of the throttle opening TH with a predetermined value DTHc used for determining the change amount. When the absolute value is equal to or less than the predetermined value DTHc, the throttle opening TH is determined to be stable. The predetermined value DTHc is set as a criterion (e.g., 2 degrees) for determining whether the throttle opening TH is stable, i.e., the change amount DTH is relatively small.

When the result in S204 or S202 is negative, the remaining steps are skipped. When the result in S204 is affirmative, i.e., when the throttle opening TH is stable at the maximum opening so that the engine 30 is in the operating condition capable of making the boat speed reach the maximum speed, the program proceeds to S206, in which it is determined whether the change amount DNE of the engine speed NE is greater than a third prescribed value DNE3 set to a positive value (e.g., 500 rpm).

When the process of S206 is first conducted, since it is immediately after the engine 30 is determined to be in the aforementioned operating condition in S204, the change amount DNE is large on the positive side. Therefore, the result is generally affirmative and the program proceeds to S208, in which the trim unit 24 is operated to start and conduct the trim-up operation, thereby increasing the boat speed.

When the result in S206 is negative, the program proceeds to S210, in which it is determined whether the change amount DNE is less than a fourth prescribed value DNE4 set to a negative value (e.g., −500 rpm). When the result in S210 is affirmative, it means that the trim angle θ has become excessive due to the trim-up operation in S208 for example. Hence, the program proceeds to S212, in which the trim angle θ is appropriately regulated through the trim-down operation.

When the result in S210 is negative, i.e., when the change amount DNE is within a predetermined range between the third prescribed value DNE3 and the fourth prescribed value DNE4 (DNE4 DNE DNE3), it is determined or estimated that the engine speed NE is saturated in the high speed range and the boat speed is at or about the maximum speed, and the program proceeds to S214, in which the trim-up (or trim-down) operation is stopped. The predetermined range is set as a criterion for determining that the boat speed has reached the maximum speed.

The program proceeds to S216, in which the present trim angle θ is detected based on the output of the trim angle sensor 104, i.e., the trim angle θ at the time when the trim-up operation is stopped (e.g., 10 degrees) is detected and stored, and the stored trim angle θ is determined as the second-speed learning trim angle δ (explained later).

Then the program proceeds to S218, in which the bit of a second-speed learning trim angle determined flag (initial value 0) is set to 1, whereafter the program is terminated. The bit of this flag being set to 1 means that the second-speed learning trim angle δ is determined Next, the operation of third-speed learning trim angle determination in FIG. 8 is explained. In S300, it is determined whether the current gear position is in the third speed. When the result in S300 is negative, the remaining steps are skipped and when the result is affirmative, the program proceeds to S302, in which it is determined whether the throttle opening TH is the maximum opening.

When the result in S302 is affirmative, the program proceeds to S304, in which it is determined whether an absolute value of the change amount DTH of the throttle opening TH is equal to or less than the predetermined value DTHc. Similarly to S202 and S204 described above, the process of S302 and S304 is conducted to determine whether the throttle opening TH is stable at the maximum opening and the engine 30 is in the operating condition capable of making the boat speed reach the maximum speed.

When the result in S302 or S304 is negative, the remaining steps are skipped. When the result in S304 is affirmative, the program proceeds to S306, in which it is determined whether the change amount DNE is less than a fifth prescribed value DNES set to a negative value (e.g., −500 rpm).

When the process of S306 is first conducted, since it is immediately after the gear position is changed (shifted up) to the third speed and the affirmative result is made in S300, the change amount DNE is large on the negative side. Therefore, the result in S306 is generally affirmative and the program proceeds to S308, in which the trim unit 24 is operated to start and conduct the trim-down operation. When it is immediately after the gear position is changed from the second speed to the third speed, if the trim angle θ established in the second speed is regulated to slightly decrease through the trim-down operation, it makes the boat speed increase.

When the result in S306 is negative, the program proceeds to S310, in which it is determined whether the change amount DNE is greater than a sixth prescribed value DNE6 set to a positive value (e.g., 500 rpm). When the result in S310 is affirmative, it means that the trim angle θ has become too small due to the trim-down operation in S308 for example. Hence, the program proceeds to S312, in which the trim angle θ is appropriately regulated through the trim-up operation.

When the result in S310 is negative, i.e., when the change amount DNE is within a second predetermined range between the fifth prescribed value DNES and the sixth prescribed value DNE6 (DNES≦DNE≦DNE6), it is determined or estimated that the engine speed NE is saturated in the high speed range and the boat speed is at or about the maximum speed, and the program proceeds to S314, in which the trim-down (or trim-up) operation is stopped. The second predetermined range is set as a criterion for determining that the boat speed has reached the maximum speed.

The program proceeds to S316, in which the present trim angle θ, i.e., the trim angle θ at the time when the trim-down operation is stopped (e.g., 8 degrees) is detected and stored, and the stored trim angle θ is determined as the third-speed learning trim angle ϵ (explained later).

Then the program proceeds to S318, in which the bit of a third-speed learning trim angle determined flag (initial value 0) is set to 1, whereafter the program is terminated. The bit of this flag being set to 1 means that the third-speed learning trim angle ϵ is determined.

The further explanation is made on the above process of S12 and S14. Depending on whether the gear position is in the second speed or third speed, the appropriate trim angle that enables the boat speed to reach the maximum speed is different. Concretely, the appropriate trim angle in the third speed is to be slightly smaller than that in the second speed. Therefore, in S12 and S14, the appropriate trim angles in the second and third speed are set by conducting the trim-up/down operation based on the change amount DNE, and the thus-obtained appropriate trim angles are stored as learning values. As described below, the learning values are utilized in the next and subsequent operation in the second and third speed.

Figure 9:
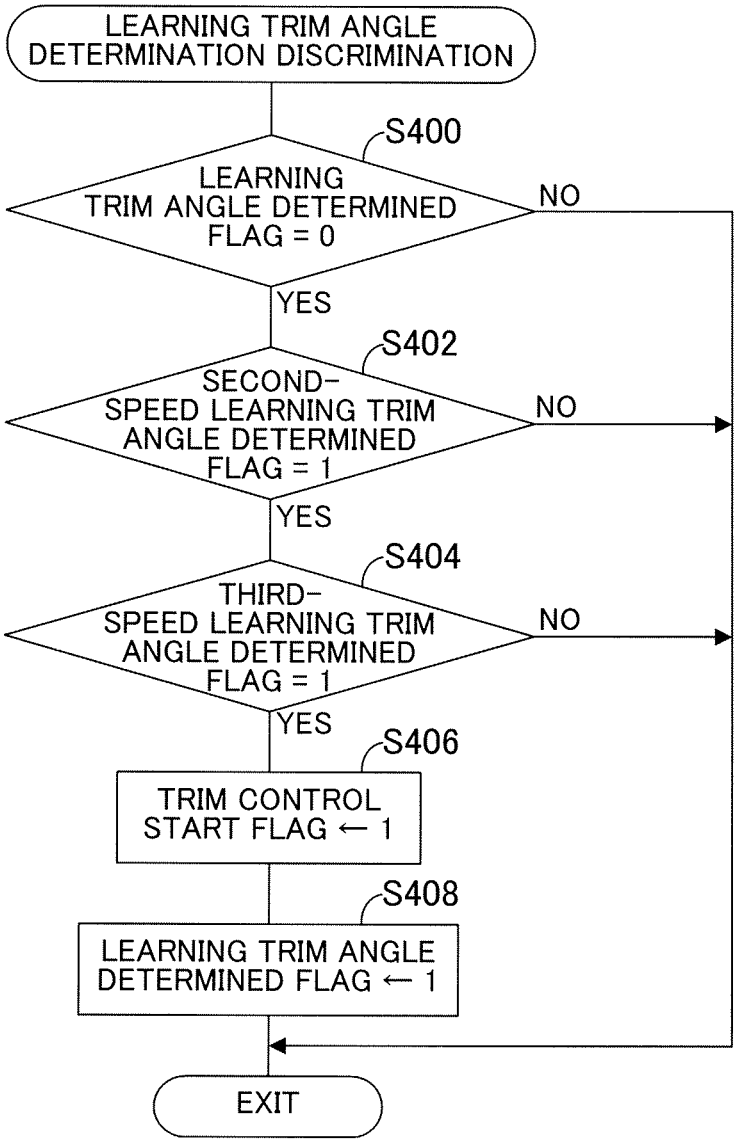
FIG. 9 is a subroutine flowchart showing the operation of learning trim angle determination of the FIG. 5 flowchart.

Returning to the explanation on the FIG. 5 flowchart, the program proceeds to S16, in which it is discriminated whether the learning trim angles δ, ϵ are determined FIG. 9 is a subroutine flowchart showing the operation of learning trim angle determination discrimination of the FIG. 5 flowchart.

In S400, it is determined whether the bit of a learning trim angle determined flag indicating that the learning trim angles δ, ϵ have been determined is 0. Since the initial value of this flag is 0, the result in S400 in the first program loop is generally affirmative and the program proceeds to S402.

In S402, it is determined whether the bit of the second-speed learning trim angle determined flag is 1. When the result in S402 is affirmative, the program proceeds to S404, in which it is determined whether the bit of the third-speed learning trim angle determined flag is 1. When the result in S404 or S402 is negative, the remaining steps are skipped and when the result in S404 is affirmative, the program proceeds to S406, in which the bit of a trim control start flag (initial value 0) is set to 1. The bit of this flag being set to 1 means that the trim angle control using the learning trim angles δ, ϵ (explained later) can be started or is permitted, while being reset to 0 means that the control can not be started or is not permitted.

Then the program proceeds to S408, in which the bit of the learning trim angle determined flag is set to 1 and the program is terminated. Upon setting of the bit of this flag to 1, the result in S400 in the next and subsequent loops becomes negative and the steps of S402 to S408 are skipped. When the outboard motor 10 is powered off by the operator, the bits of the trim control start flag and learning trim angle determined flag are reset to 0.

Returning to the explanation on the FIG. 5 flowchart, the program proceeds to S18, in which it is determined whether the trim angle θ should be regulated in response to the start of steering of the outboard motor 10.

Figure 10:
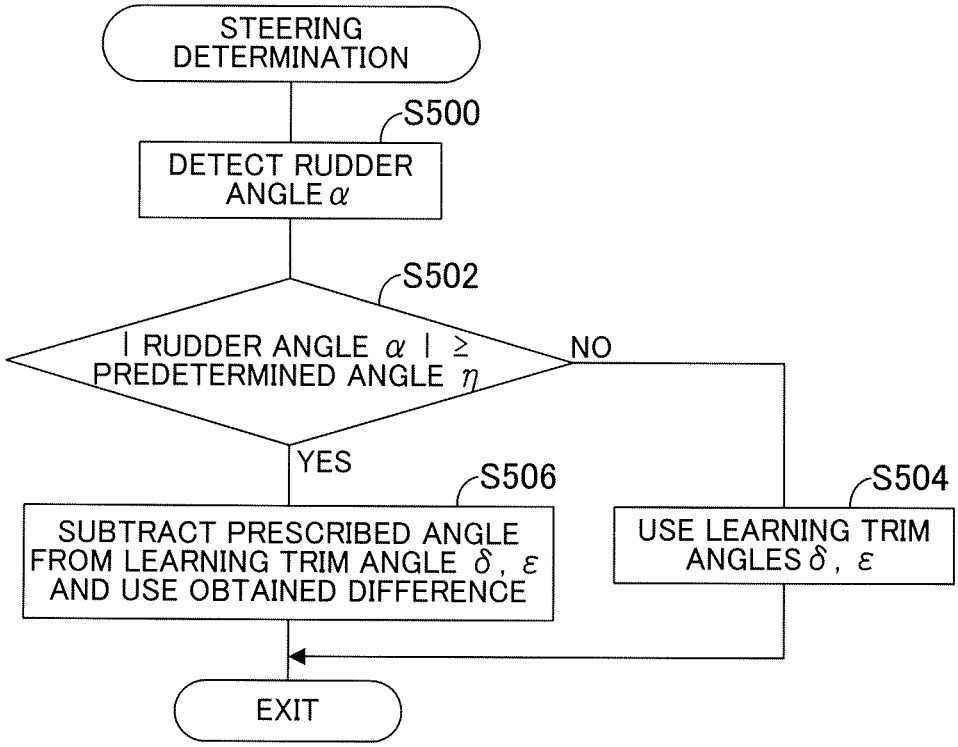
FIG. 10 is a subroutine flowchart showing the operation of steering determination of the FIG. 5 flowchart.

FIG. 10 is a subroutine flowchart showing the operation of steering determination. In S500, the rudder angle α is detected or calculated from the output of the rudder angle sensor 106, and in S502, it is determined whether it is necessary to regulate the trim angle θ in response to the start of steering of the outboard motor 10.

Specifically, in S502, an absolute value of the detected rudder angle α is compared to a predetermined angle η and when the absolute value is equal to or greater than the predetermined angle η, it is determined that the outboard motor 10 is started to be steered and in the condition where cavitation likely occur and hence, it is necessary to regulate the trim angle θ. The predetermined angle η is set as a criterion (e.g., 10 degrees) for determining whether the outboard motor 10 is in the foregoing condition.

When the result in S502 is negative, the program proceeds to S504, in which the second-speed and third-speed learning trim angles δ, ϵ are directly used in trim angle regulating process (i.e., second-speed and third-speed trim-up/down determination; explained later). When the result in S502 is negative, the program proceeds to S506, in which a prescribed angle (e.g., 3 degrees) is subtracted from each of the learning trim angles δ, ϵ and the obtained difference is used in the trim angle regulating process.

Owing to the configuration, when the trim angle θ is the second-speed learning trim angles δ for example, the trim-down operation is started to decrease the trim angle θ in the trim angle regulating process. Thus, when the outboard motor 10 is started to be steered, the trim angle θ is decreased based on the rudder angle α.

In a program loop after the learning trim angles δ, ϵ are reduced, when the steering wheel 114 is returned to the initial position by the operator so that the absolute value of the rudder angle α is decreased, the result in S502 is negative. Specifically, since it is determined that the steering of the outboard motor 10 is finished and it is not necessary to decrease the trim angle θ, the program proceeds to S504, in which the decreased learning trim angles δ, ϵ are returned to the original values. As a result, the trim-up operation is started in the trim angle regulating process so that the trim angle θ is increased. Thus, when the steering of the outboard motor 10 is finished, the trim angle θ is increased based on the decrease in the rudder angle α.

Returning to the explanation on the FIG. 5 flowchart, the program proceeds to S20, in which it is determined whether the gear position is in the second speed and the trim-up/down operation should be conducted, and to S22, in which it is determined whether the gear position is in the third speed and the trim-up/down operation should be conducted.

Figure 11:
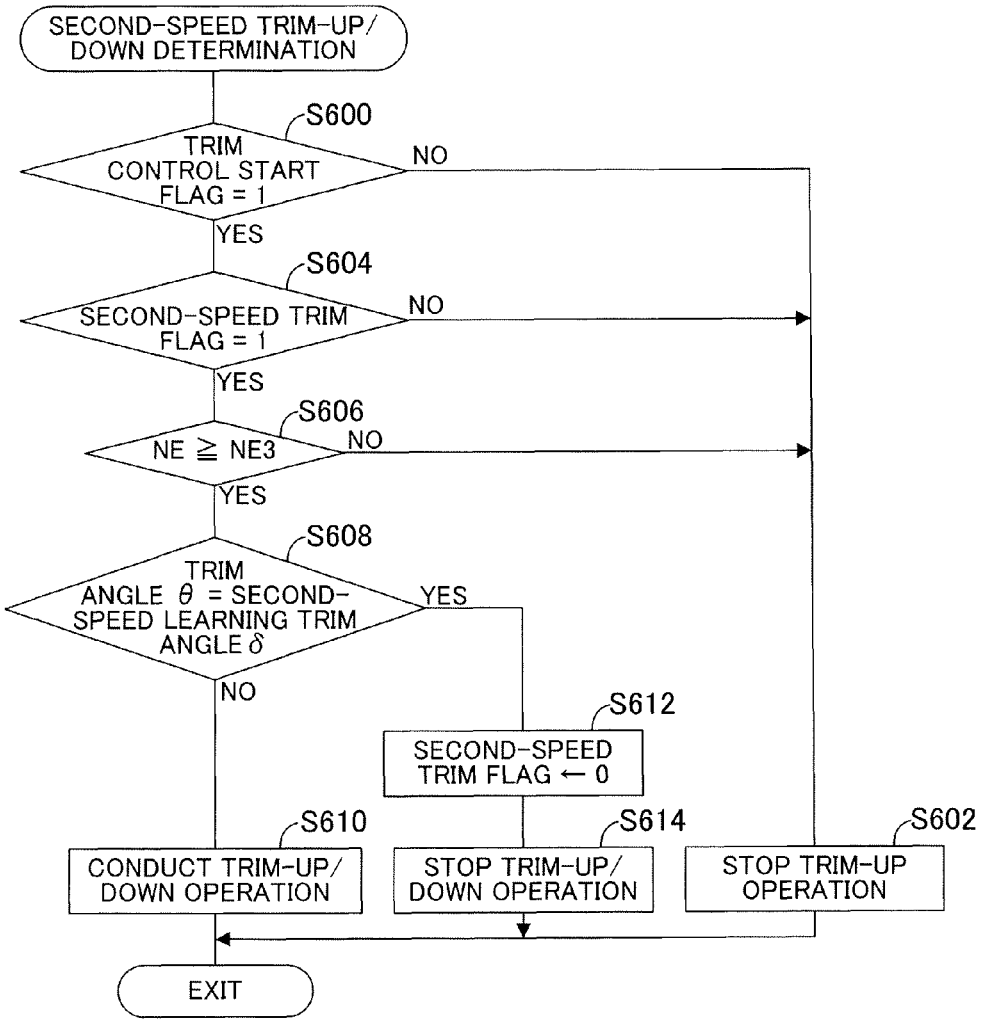
FIG. 11 is a subroutine flowchart showing the operation of second-speed trim-up/down determination of the FIG. 5 flowchart.
Figure 12:
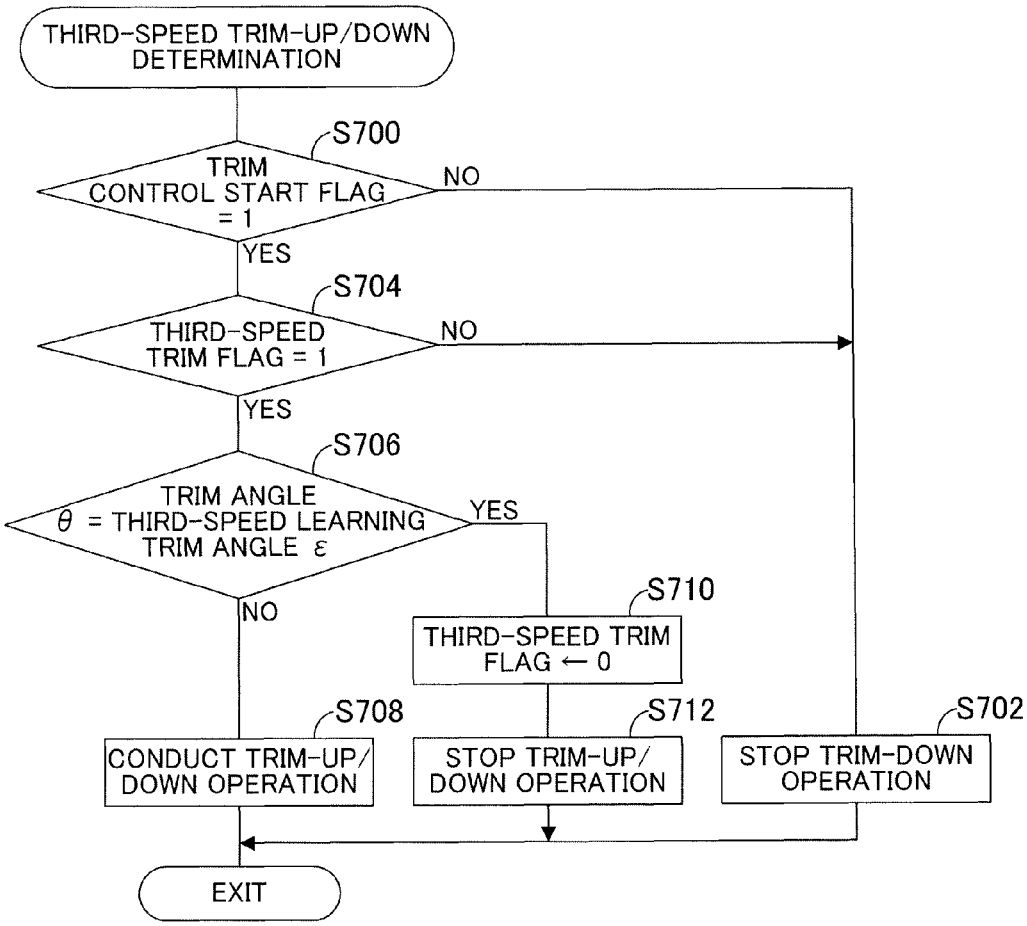
FIG. 12 is a subroutine flowchart showing the operation of third-speed trim-up/down determination of the FIG. 5 flowchart.

FIG. 11 is a subroutine flowchart showing the operation of second-speed trim-up/down determination and FIG. 12 is a subroutine flowchart showing the operation of third-speed trim-up/down determination.

As shown in FIG. 11, in S600, it is determined whether the bit of the trim control start flag is 1. When the result in S600 is negative, the program proceeds to S602, in which the trim-up operation is stopped, i.e, the trim-up operation using the learning trim angle δ is not conducted.

When the result in S600 is affirmative, the program proceeds to S604, in which it is determined whether the bit of the second-speed trim flag is 1. When the result in S604 is negative, since it means that the trim-up operation is not needed, the program proceeds to S602, in which the trim-up operation is not conducted. When the result in S604 is affirmative (e.g., when the change amount DTH is equal to or greater than the predetermined value DTHb and the gear position is changed to the first speed), the program proceeds to S606, in which it is determined whether the engine speed NE is equal to or greater than a third predetermined speed (predetermined speed) NE3.

The third predetermined speed NE3 is set to a value (e.g., 5000 rpm) slightly lower than the first predetermined speed NE1 which is the threshold value used when the transmission 46 is changed back from the first speed to the second speed after the acceleration is completed. Therefore, the process in S606 amounts to determining whether the engine speed NE represents the condition where it is immediately before the acceleration in the first speed is completed and the transmission 46 is changed back from the first speed to the second speed.

When the result in S606 is negative, since it is not the time to start the trim-up operation, the program proceeds to S602 and the program is terminated without conducting the trim-up operation. On the other hand, when the result in S606 is affirmative, the program proceeds to S608, in which it is determined whether the trim angle θ is at the second-speed learning trim angle δ.

When the result in S608 is negative, the program proceeds to S610, in which the trim unit 24 is operated to start and conduct the trim-up or trim-down operation. In the case where the process of S610 is first conducted, since the trim angle θ is 0 degree, the trim-up operation is conducted. Specifically, when the engine speed NE is equal to or greater than the third predetermined speed NE3, the trim-up operation is started. Thus, after the second-speed learning trim angle δ is determined, the trim-up operation is started before the acceleration is completed and the transmission 46 is changed back from the first speed to the second speed, thereby increasing the boat speed.

After the trim angle θ is regulated through the trim-up operation, when the result in S608 in the next program loop is affirmative, the program proceeds to S612, in which the bit of the second-speed trim flag is reset to 0 and to S614, in which the trim-up or trim-down operation is stopped. Thus, when the gear position is in the second speed, the trim angle θ is converged to the learning trim angle δ, thereby making the boat speed reach the maximum speed.

Further, in a program loop after the prescribed angle is subtracted from the learning trim angle δ, the result in S608 is negative and the program proceeds to S610, in which the trim-down operation is conducted until the trim angle θ becomes the decreased learning trim angle δ. Also when the steering of the outboard motor 10 is finished and the learning trim angle δ is returned to the original value, the result in S608 is negative and the program proceeds to S610, in which the trim-up operation is conducted until the trim angle θ becomes the returned learning trim angle δ.

Next, the operation of third-speed trim-up/down determination in FIG. 12 is explained. In S700, it is determined whether the bit of the trim control start flag is 1. When the result in S700 is negative, the program proceeds to S702, in which the trim-down operation is stopped, i.e, the trim-down operation using the learning trim angle ϵ is not conducted.

When the result in S700 is affirmative, the program proceeds to S704, in which it is determined whether the bit of the third-speed trim flag is 1. When the result in S704 is negative, since it means that the trim-down operation is not needed, the program proceeds to S702, in which the trim-down operation is not conducted. When the result in S704 is affirmative, i.e., when the gear position is changed to the third speed, the program proceeds to S706, in which it is determined whether the trim angle θ is equal to or greater than the third-speed learning trim angle ϵ.

When the result in S706 is negative, the program proceeds to S708, in which the trim unit 24 is operated to start and conduct the trim-down or trim-up operation. In the case where the process of S708 is first conducted, the trim angle θ is generally at the second-speed learning trim angle δ greater than the third-speed learning trim angle ϵ, the trim-down operation is conducted. After the trim angle θ is regulated through the trim-down operation, when the result in S706 in the next program loop is affirmative, the program proceeds to S710, in which the bit of the third-speed trim flag is reset to 0 and to S712, in which the trim-down operation is stopped. Thus, after the third-speed learning trim angle ϵ is determined, the trim-down operation is started when the transmission 46 is changed to the third speed, so that the trim angle θ is converged to the learning trim angle ϵ, thereby making the boat speed reach the maximum speed.

Further, in a program loop after the prescribed angle is subtracted from the learning trim angle ϵ, the result in S706 is negative and the program proceeds to S708, in which the trim-down operation is conducted until the trim angle θ becomes the decreased learning trim angle ϵ. Also when the steering of the outboard motor 10 is finished and the learning trim angle ϵ is returned to the original value, the result in S706 is negative and the program proceeds to S708, in which the trim-up operation is conducted until the trim angle θ becomes the returned learning trim angle ϵ.

Returning to the explanation on the FIG. 5 flowchart, the program proceeds to S24, in which it is determined whether the trim-down operation for regulating the trim angle θ back to the initial angle should be conducted.

Figure 13:
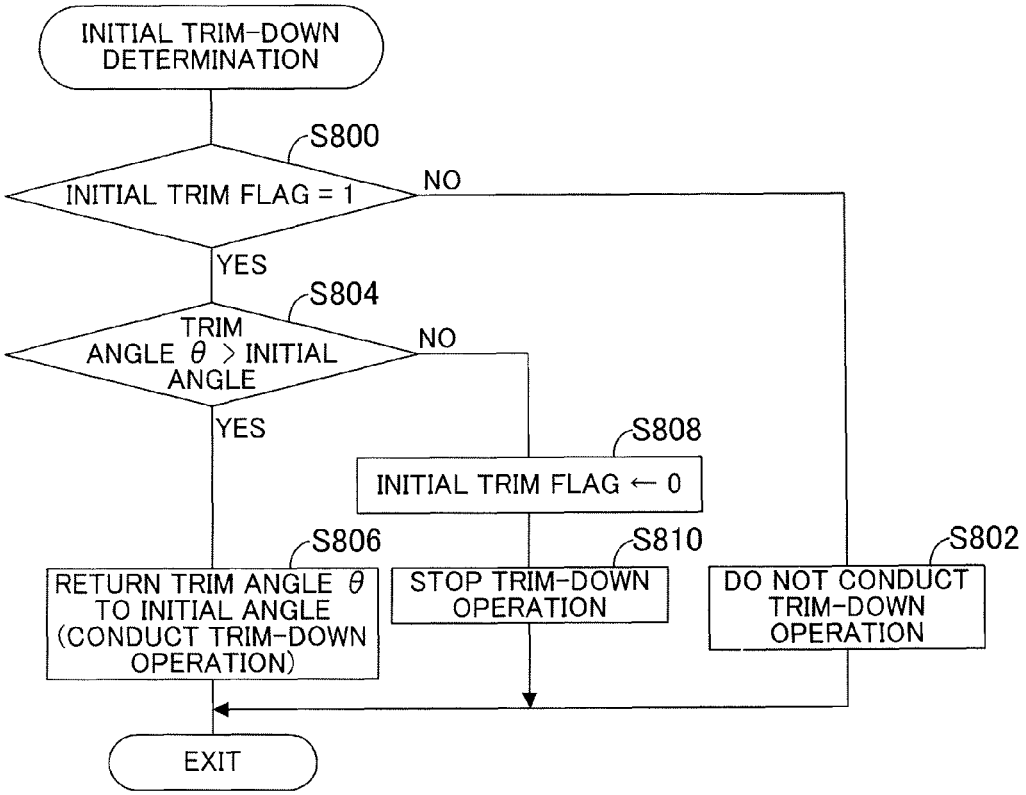
FIG. 13 is a subroutine flowchart showing the operation of initial trim-down determination of the FIG. 5 flowchart.

FIG. 13 is a subroutine flowchart showing the operation of initial trim-down determination.

In S800, it is determined whether the bit of an initial trim flag is 1. When the result is negative, the program proceeds to S802, in which the trim-down operation based on the initial trim flag is not conducted.

When the result in S800 is affirmative, the program proceeds to S804, in which it is determined whether the trim angle θ is greater than the initial angle. When the result in S804 is affirmative, the program proceeds to S806, in which the trim unit 24 is operated to conduct the trim-down operation to regulate or return the trim angle θ to the initial angle. When the result in S804 is negative, the program proceeds to S808, in which the bit of the initial trim flag is reset to 0 and to S810, in which the trim-down operation is stopped and the program is terminated.

Figure 14:
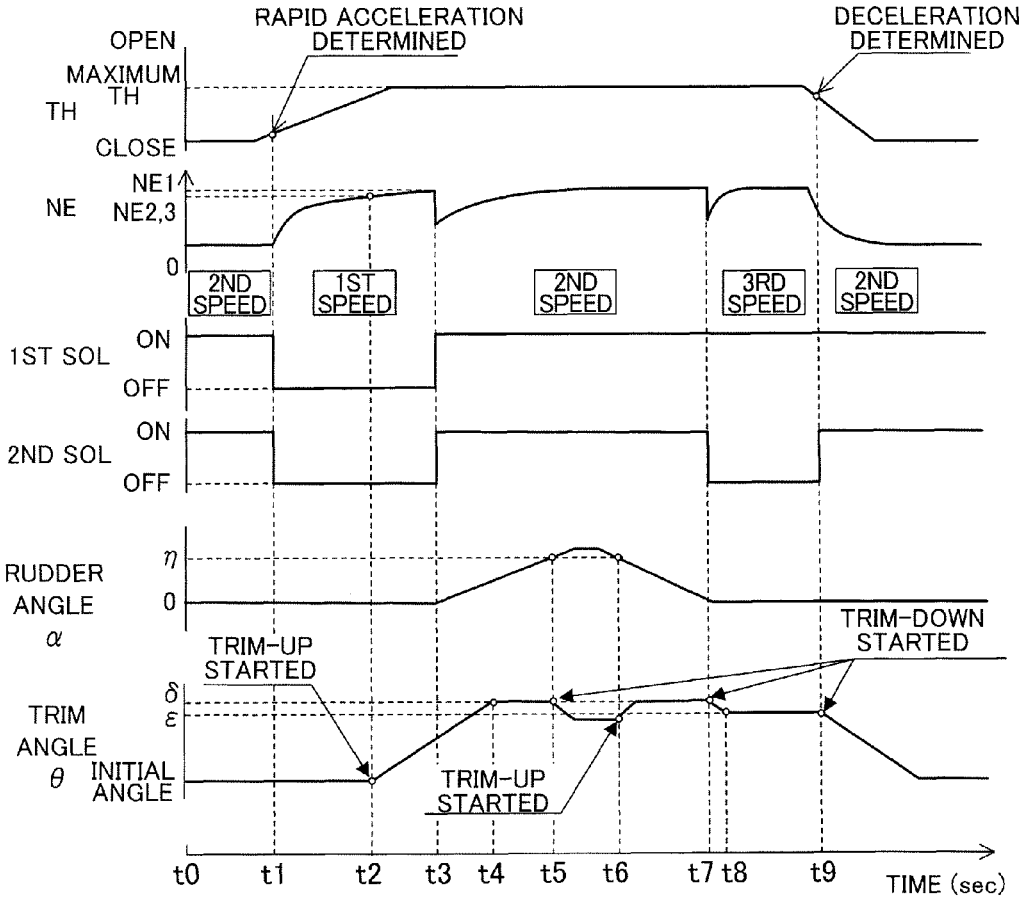
FIG. 14 is a time chart for explaining the operation of the flowcharts in FIGS. 5 to 13.

FIG. 14 is a time chart for explaining the operation of the outboard motor 10 when it is steered and FIGS. 15A to 15D are explanatory views thereof. Note that, in the following, the learning trim angles δ, ϵ are already determined In FIGS. 15, a symbol y indicates the front-back direction of the outboard motor 10, a symbol z the vertical direction thereof, a symbol W seawater or freshwater, and a symbol S the water surface. The front-back direction y and vertical direction z represent those with respect to the outboard motor 10 and they may differ from the gravitational direction and horizontal direction depending on the tilt angle or trim angle of the outboard motor 10.

In the normal operation from the time t0 to t1, the transmission 46 is set in the second speed (S122). Then, when the throttle valve 38 is opened upon the manipulation of the lever 122 by the operator and, at the time t1, the change amount DTH is equal to or greater than the predetermined value DTHb (S120), the gear position is changed from the second speed to the first speed (S126).

Figure 15A:
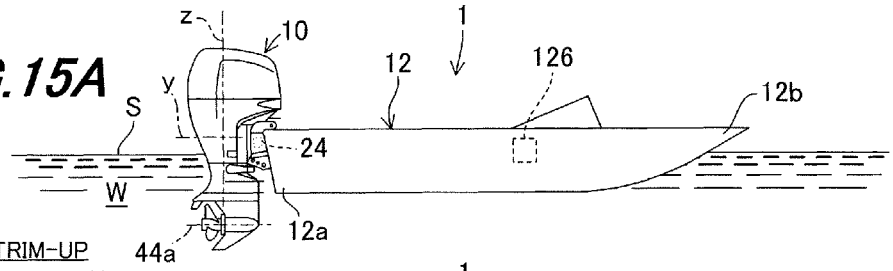
FIGS. 15 are explanatory views for explaining the operation of the flowcharts in FIGS. 5 to 13.
Figure 15B:
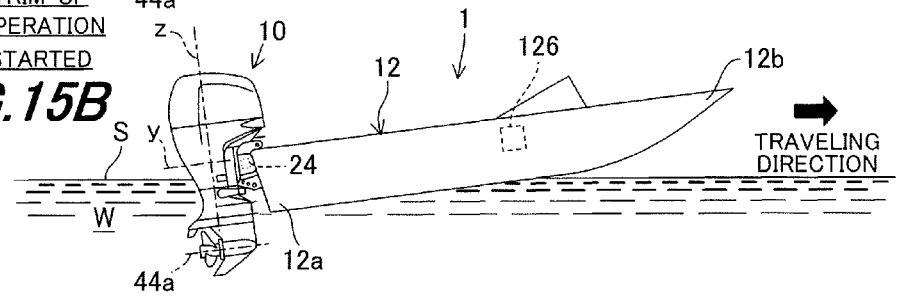

As shown in FIG. 15A, at the time t0 to t1, the hull 12 and outboard motor 10 are both in the horizontal position and the trim angle θ is at the initial angle (0 degree). When the gear position is changed to the first speed upon the acceleration at the time t1 and the boat speed is increased, as shown in FIG. 15B, the bow 12*b* of the hull 12 is lifted up and the stern 12*a* thereof is sunk down (the boat speed lies the so-called "hump" region). As can be seen from the drawing, the axis line 44*a* of the propeller shaft 44 is not parallel with the traveling direction of the boat 1.

When the acceleration is continued so that the engine speed NE is gradually increased and reaches the third predetermined speed NE3 or more at the time t2, the trim-up operation of the outboard motor 10 is started (S606, S610). Subsequently, when the engine speed NE is further increased and becomes equal to or greater than the first predetermined speed NE1 (S116, time t3), the gear position is changed from the first speed to the second speed (S134). Then, when, at the time t4, the trim angle θ reaches the second-speed learning trim angles δ, the trim-up operation is stopped (S608, S614).

The condition where the trim-up operation is stopped is shown in FIG. 10C. As clearly shown, since the outboard motor 10 is trimmed up to regulate the trim angle θ, the axis line 44*a* of the propeller shaft 44 (i.e., the direction of thrust of the outboard motor 10) can be positioned substantially parallel with the traveling direction of the boat 1. As a result, the resistance against the hull 12 from the water surface S can be decreased, while the thrust of the hull 12 can be increased, thereby enabling the boat speed in the second speed to reach the maximum speed.

When, at the time t5, the outboard motor 10 is started to be steered and the rudder angle α becomes equal to or greater than the predetermined angle η, the prescribed angle is subtracted from the learning trim angle δ and based on the obtained difference, the trim angle θ is decreased (S502, S506). After that, when the steering of the outboard motor 10 is finished and the rudder angle α becomes less than the predetermined angle η, the learning trim angle δ is returned to the original value to increase the trim angle θ (S502, S504).

When the fuel consumption decreasing command is inputted by the operator through the switch 130 (S138) and, at the time t7, the engine speed NE is equal to or greater than the second predetermined speed NE2 (S154), the gear position is changed from the second speed to the third speed (S158) and the trim-down operation is started (S706, S708). Then, when, at the time t8, the trim angle θ reaches the third-speed learning trim angle ϵ, the trim-down operation is stopped (S706, S712).

Figure 15C:
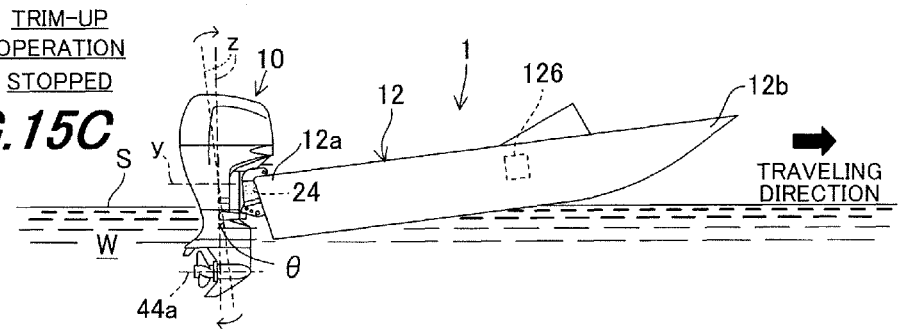
Figure 15D:
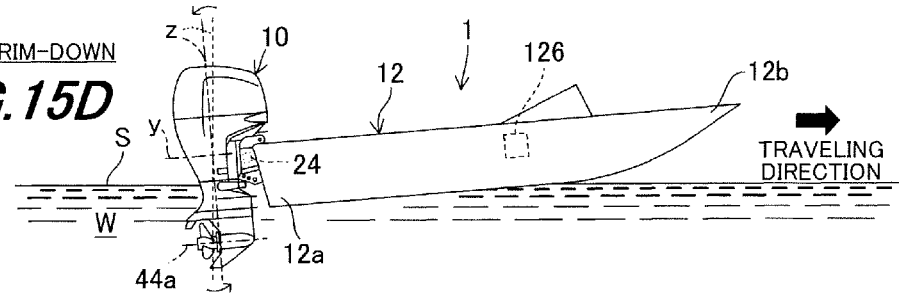

Although not illustrated, when the trim-down operation is stopped, similarly to the condition shown in FIG. 15C, the axis line 44*a* of the propeller shaft 44 is positioned substantially parallel with the traveling direction of the boat 1, thereby enabling the boat speed in the third speed to reach the maximum speed.

When, at the time t9, the lever 122 is manipulated by the operator and the change amount DTH is less than the predetermined value DTHa (S106), the gear position is changed from the third speed to the second speed (S166) and the trim-down operation is started to regulate the trim angle θ to the initial angle (S800, S806). FIG. 10D is a view showing the condition where the trim angle θ has been returned to the initial angle.

As stated above, in the apparatus and method according to the first embodiment, there are provided with a transmission controller (ECU 110, S10, S120, S126) that controls operation of the transmission to change the gear position from the second speed to the first speed when the second speed is selected and the detected change amount of the throttle opening DTH is equal to or greater than a first predetermined value (acceleration-determining predetermined value) DTHb; and a trim angle controller (ECU 110, S20, S22, S608-S614, S706-S712) that controls operation of the trim angle regulation mechanism to start the trim-up operation such that the trim angle converges to a predetermined angle (second-speed learning trim angle δ, third-speed learning trim angle ϵ when the detected engine speed is equal to or greater than a predetermined speed (third predetermined speed NE3), wherein the trim angle controller controls the operation of the trim angle regulation mechanism such that the trim angle θ is decreased based on the detected rudder angle α when steering of the outboard motor is started (S18, S502, S506).

With this, it becomes possible to prevent cavitation caused by steering of the outboard motor 10, so that the boat 1 can be smoothly turned. To be more specific, the predetermined speed NE3 is set to a value corresponding to the condition immediately before the acceleration is completed and the gear position is changed back from the first speed to the second speed, while the learning trim angles δ, ϵ are set to values with which the water resistance against the boat 1 is decreased to increase the thrust so that the trim-up operation is conducted, thereby increasing the boat speed to reach the maximum speed. In the case where the outboard motor 10 is steered with the maximum boat speed, since the trim angle θ is decreased based on the rudder angle α (the trim-down operation is conducted), it becomes possible to prevent cavitation and the boat 1 can be smoothly turned.

In the apparatus and method, the trim angle controller controls the operation of the trim angle regulation mechanism such that the trim angle θ is increased based on decrease in the detected rudder angle α when the steering of the outboard motor is finished (S18, S502, S504).

With this, it becomes possible to return the trim angle θ to the predetermined angle, thereby increasing the boat speed to again reach the maximum speed.

In the apparatus and method, the trim angle controller controls the operation of the trim angle regulation mechanism to start the trim-down operation such that the trim angle converges to an initial angle when the detected change amount of the throttle opening is less than a second predetermined value (deceleration-determining predetermined value DTHa) (S10, S24, S106, S176, S800-S810).

With this, in addition to the above effects, the trim angle θ can be returned to the initial angle at the right time in accordance with the operating condition of the outboard motor 10. Also, in the case where the trim angle θ is regulated to the predetermined angle next time, since the outboard motor 10 can be trimmed up from the initial angle, it becomes possible to reliably and easily regulate the trim angle θ to the predetermined angle.

The apparatus and method further include: a pitching detector (acceleration sensor 126, ECU 110, S142) that detects a pitching of the boat, and the trim angle controller stops the trim-up operation when the pitching is detected by the pitching detector (S10, S22, S142, S144, S602, S604).

With this, in addition to the above effects, since the trim-up operation can be stopped immediately after the pitching of the hull 12 occurs, it becomes possible to prevent the pitching caused by excessive trim-up operation to the maximum extent.

In the apparatus and method, the trim angle controller restarts the trim-up operation when a predetermined time period elapses after the trim-up operation is stopped (S10, S20, S140, S150, S604, S610).

With this, in addition to the above effects, the trim-up operation can be restarted when the predetermined time period has elapsed and there is no pitching anymore.

An outboard motor control apparatus according to a second embodiment of the invention will be explained.

In the second embodiment, when the shift-up/down operation is conducted, not only the trim angle θ is regulated but also the operation of the transmission 46 is controlled based on the rudder angle α.

Figure 16:
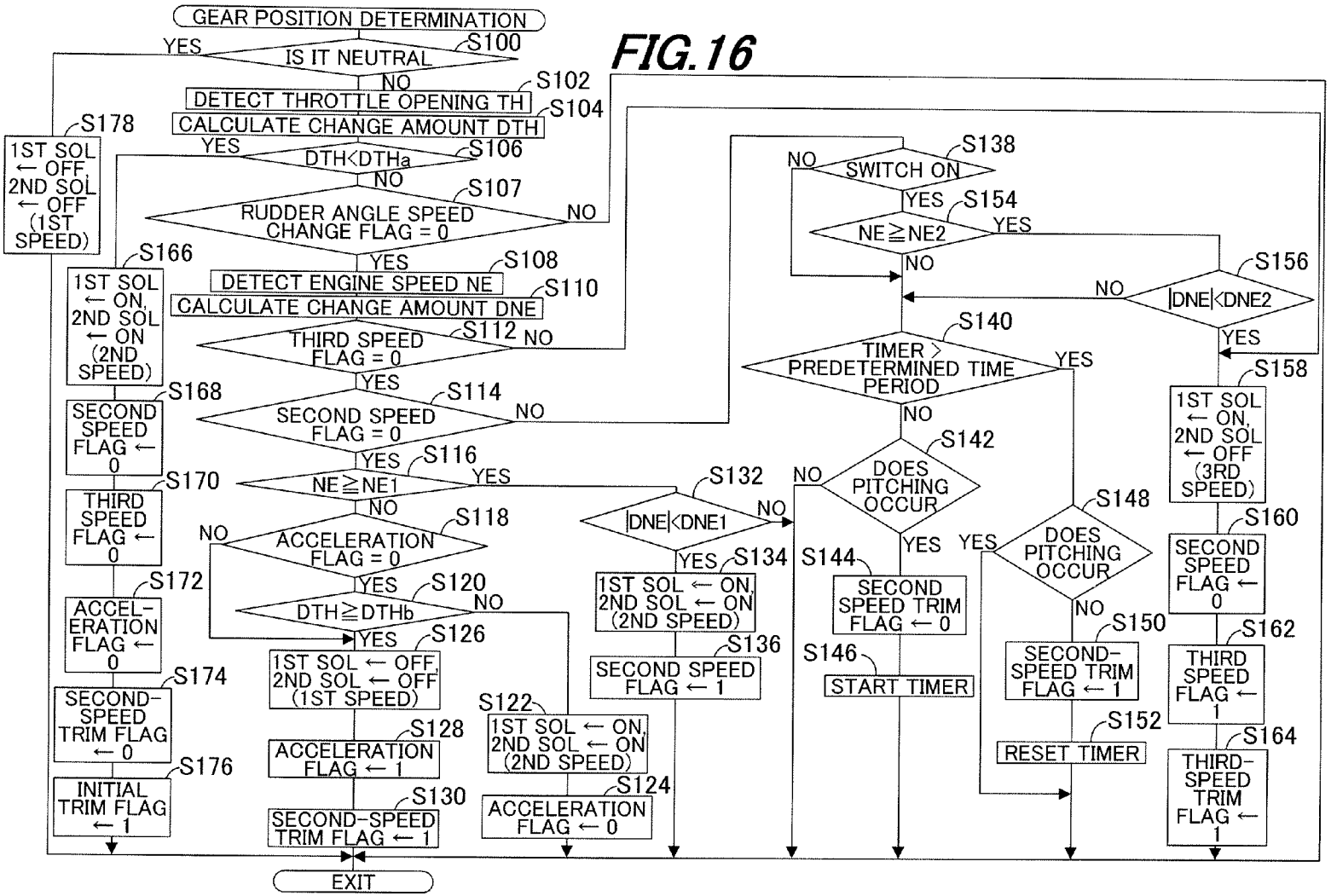
FIG. 16 is a subroutine flowchart similar to FIG. 6, but showing an alternative example of the operation of gear position determination of the FIG. 5 flowchart by an electronic control unit of an outboard motor control apparatus according to a second embodiment of the invention.

FIG. 16 is a subroutine flowchart similar to FIG. 6, but showing an alternative example of the operation of gear position determination of the FIG. 5 flowchart. Note that constituent elements corresponding to those of FIG. 6 are assigned by the same reference symbols.

The process of steps up to S106 is conducted as described in the first embodiment. When the result in S106 is negative, the program proceeds to S107, in which it is determined whether the bit of a rudder angle speed change flag indicating that the gear position is to be changed based on the rudder angle in the process which will be explained later, is 0. When the result in S107 is negative, since it is not necessary to change the gear position in this gear position determination operation, the remaining steps are skipped and when the result is affirmative, the program proceeds to S108 onward and processed as mentioned in the first embodiment. Then, following S12 to S16, the program proceeds to S18, in which the operation of steering determination is conducted.

Figure 17:
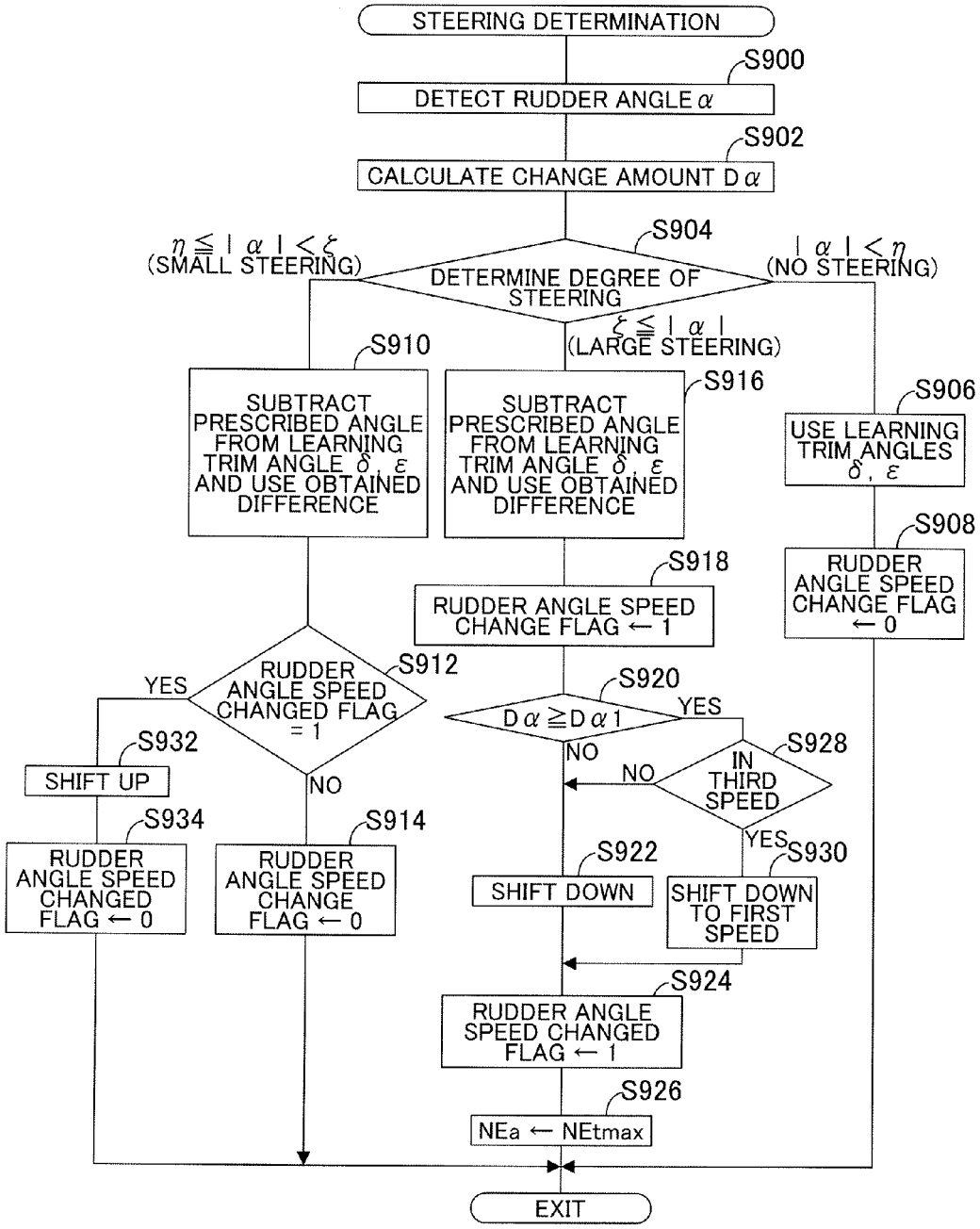
FIG. 17 is a subroutine flowchart similar to FIG. 10, but showing the operation of steering determination of the FIG. 5 flowchart.

FIG. 17 is a subroutine flowchart showing an alternative example of the operation of steering determination of the FIG. 5 flowchart. In S900, the rudder angle α is detected or calculated from the output of the rudder angle sensor 106, and in S902, a change amount (variation) Dα of an absolute value of the detected rudder angle α per unit time (e.g., 500 milliseconds) is calculated.

The program proceeds to S904, in which it is determined based on the detected rudder angle α whether the outboard motor 10 is started to be steered and in the condition where cavitation likely occur. In the case where the steering of the outboard motor 10 has been started, the degree of the steering is determined. To be specific, when the absolute value of the rudder angle α is less than a first predetermined angle η set to a relatively small value (e.g., 5 degrees), the outboard motor 10 is determined to be not steered or steered slightly and the program proceeds to S906, in which the second-speed and third-speed learning trim angles δ, ϵ are directly used in the trim angle regulating process (i.e., second-speed and third-speed trim-up/down determination). Then the program proceeds to S908, in which the bit of the rudder angle speed change flag is reset to 0 and the program is terminated.

In S904, when the absolute value of the rudder angle α is equal to or greater than the first predetermined angle η and less than a second predetermined angle (predetermined rudder angle) ζ set to a value (e.g., 10 degrees) larger than the first predetermined angle η, it is determined that, although the steering is started so that cavitation likely occur, the steering is relatively small. The program proceeds to S910, in which a prescribed angle (e.g., 3 degrees) is subtracted from each of the learning trim angles δ, ϵ and the obtained difference is used in the trim angle regulating process.

Owing to the configuration, when the trim angle θ is the second-speed learning trim angle δ for example, the trim-down operation is started to decrease the trim angle θ in the trim angle regulating process. Thus, when the outboard motor 10 is started to be steered, the trim angle θ is decreased based on the rudder angle α.

Next, the program proceeds to S912, in which it is determined whether the bit of a rudder angle speed changed flag is 1. Since the initial value of this flag is 0, the result is generally negative and the program proceeds to S914, in which the bit of the rudder angle speed change flag is reset to 0, whereafter the program is terminated.

When the absolute value of the rudder angle $\alpha$ is equal to or greater than the second predetermined angle $\zeta$ in S904, it is determined that the relatively large steering is started and the program proceeds to S916, in which, similarly to S910, the prescribed angle is subtracted from each of the learning trim angles $\delta$, $\epsilon$ and the obtained difference is used in the trim angle regulating process. As a result, the trim angle $\theta$ is decreased.

Further, in the case where the steering is large, since the decrease in the boat speed leads to the smooth turn of the boat 1, the transmission 46 is further shifted down in the following process. Specifically, in S918, the bit of the rudder angle speed change flag is set to 1. The bit of this flag being set to 1 means that the gear position is changed based on the rudder angle $\alpha$, while being reset to 0 means that the gear position is not changed.

Then the program proceeds to S920, in which it is determined whether the steering of this time is sharply conducted (i.e., it is the sharp steering). This determination is made based on the change amount $D\alpha$ of the rudder angle $\alpha$. More specifically, the change amount $D\alpha$ is compared to a threshold value $D\alpha$1 used for determining the sharp steering and when it is equal to or greater than the threshold value $D\alpha$1, the steering of this time is determined to be the sharp one. The threshold value $D\alpha$1 is set as a criterion (e.g., 10 degrees) for determining whether it is the sharp steering.

When the result in S920 is negative, the program proceeds to S922, in which the operation of the first and second solenoid valves 86*a*, 86*b* is controlled to shift down the gear position (to the first speed in the case of the second speed and to the second speed in the case of the third speed). The program proceeds to S924, in which the bit of the rudder angle speed changed flag is set to 1. The bit of this flag being set to 1 means that the transmission 46 is shifted down based on the rudder angle $\alpha$, and otherwise, reset to 0.

Then the program proceeds to S926, in which the desired engine speed NEa set in accordance with the position of the lever 122 is changed so that the output torque of the engine 30 becomes maximum. Specifically, regardless of the lever position, the desired engine speed NEa is set with an engine speed (hereinafter called the "maximum torque engine speed") NEtmax with which the maximum output torque can be achieved.

Figure 18:
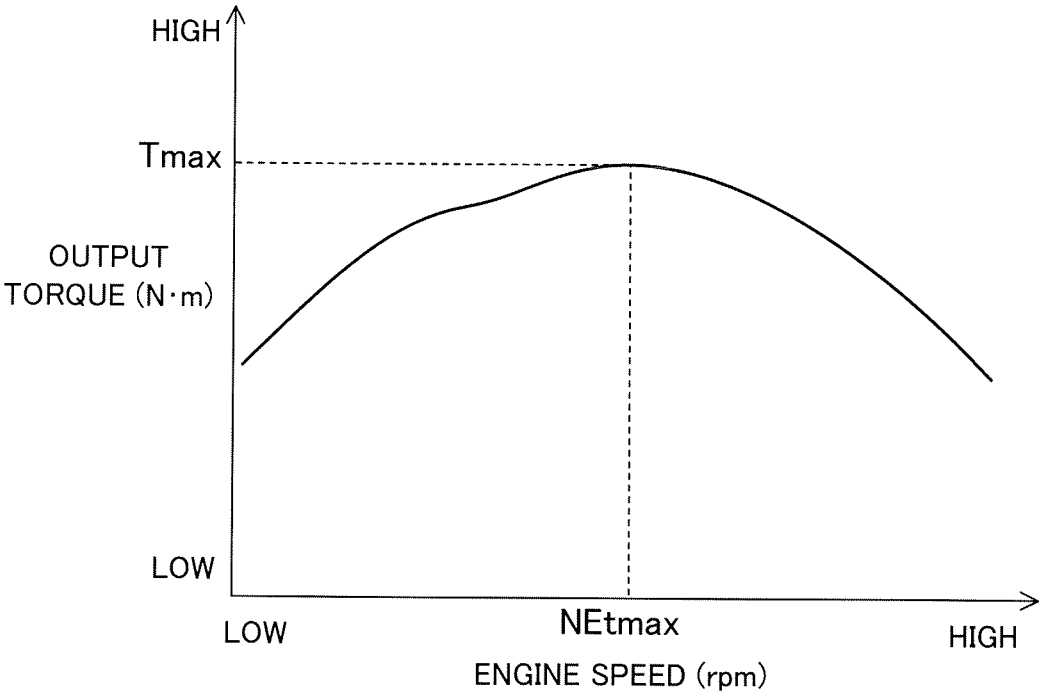
FIG. 18 is a graph showing the characteristics of an output torque relative to an engine speed of the outboard motor shown in FIG. 1.

FIG. 18 is a graph (engine performance graph) showing the characteristics of the output torque relative to the engine speed NE of the engine according to the second embodiment.

The maximum torque engine speed NEtmax is explained with reference to FIG. 18. The output torque of the engine 30 is relatively small when the engine speed NE is low, gradually increased with increasing engine speed, and reaches its maximum value (indicated by "Tmax" in the drawing) when the engine speed NE becomes a certain engine speed. This certain engine speed is the maximum torque engine speed NEtmax. In the case where the engine speed NE exceeds the maximum torque engine speed NEtmax and is increased further, the output torque is gradually decreased.

Thus, after the gear position is shifted down based on the rudder angle $\alpha$, the desired engine speed NEa is changed so that the output torque becomes maximum, i.e., is set with the maximum torque engine speed NEtmax. As a result, the operation of the engine 30 can be controlled to achieve the maximum output torque without revving the engine speed.

When the result in S920 is affirmative, the program proceeds to S928, in which it is determined whether the present gear position is in the third speed. When the result in S928 is negative, the program proceeds to S922 described above and when the result is affirmative, proceeds to S930, in which the gear position is shifted down from the third speed to the first speed. Following S930, the process of S924 and S926 is conducted and the program is terminated.

In a program loop after the learning trim angles $\delta$, $\epsilon$ are reduced in S916 and the transmission 46 is shifted down in S922 or S930, when the steering is finished and accordingly, the steering wheel 114 is returned to the initial position by the operator, so that the rudder angle $\alpha$ is gradually decreased to a value below the second predetermined angle $\zeta$, in S904, it is determined that the steering is relatively small and the program proceeds to S910.

Since the learning trim angles $\delta$, $\epsilon$ have been reduced in S916, the program proceeds to S912 without further subtraction. In S912, the result is affirmative and the program proceeds to S932, in which the transmission 46 which has been shifted down in response to the steering is shifted up to change the gear position back to the speed of before the shift down operation. Thus, after the steering is finished, the transmission 46 is shifted up in response to the decrease in the rudder angle $\alpha$. Then the program proceeds to S934, in which the bit of the rudder angle speed changed flag is reset to 0.

When the rudder angle $\alpha$ is further decreased to a value below the first predetermined angle $\eta$, since it is not necessary to decrease the trim angle $\theta$, the program proceeds to S904 to S906, in which the decreased learning trim angles $\delta$, $\epsilon$ are returned to the original values. As a result, the trim-up operation is started in the trim angle regulating process so that the trim angle $\theta$ is increased. Thus, after the transmission 46 is shifted up in S932, the trim angle $\theta$ is increased in response to the decrease in the rudder angle $\alpha$.

The process of S20 to S24 is conducted similarly to those in the first embodiment and the explanation thereof is omitted.

Figure 19:
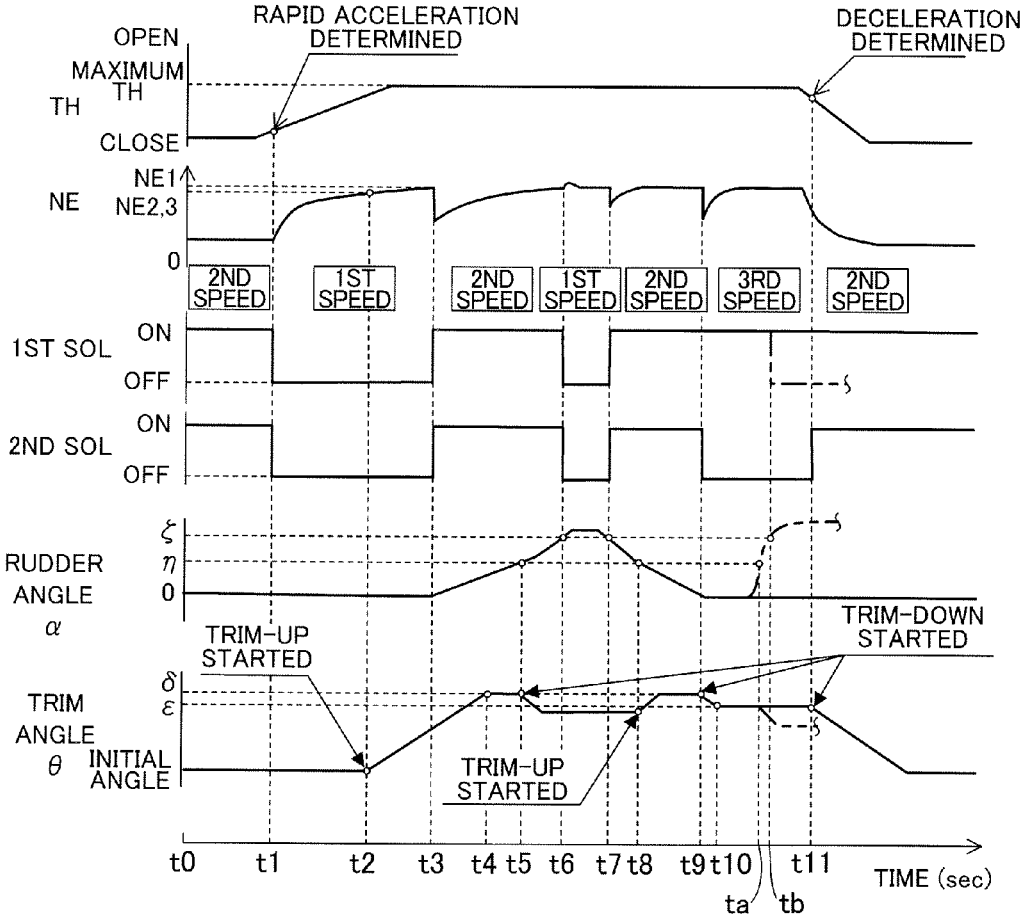
FIG. 19 is a time chart for explaining the operation of the flowcharts in FIGS. 5, 16 and 17.

FIG. 19 is a time chart similar to FIG. 14, but for explaining the operation of the above flowcharts.

The explanation on the time t0 to t4 is omitted here, as it is the same as in the first embodiment.

After the trim angle $\theta$ is reached to the second-speed learning trim angle $\delta$ and the trim-up operation is stopped at the time t4, when the steering of the outboard motor 10 is started and, at the time t5, the rudder angle $\alpha$ becomes equal to or greater than the first predetermined angle $\eta$, the prescribed angle is subtracted from the learning trim angle $\delta$ and the obtained difference is used to decrease the trim angle $\theta$ (S904, S910). After that, when, at the time t6, the rudder angle $\alpha$ becomes equal to or greater than the second predetermined angle $\zeta$, the gear position is shifted down from the second speed to the first speed (S904, S922). Simultaneously, the desired engine speed NEa is set with the maximum torque engine speed NEtmax (S926).

Then, when the steering is finished and, at the time t7, the rudder angle $\alpha$ becomes less than the second predetermined angle $\zeta$, the gear position is shifted up from the first speed to the second speed (S904, S932). When, at the time t8, the rudder angle $\alpha$ becomes less than the first predetermined angle $\eta$, the learning trim angle $\delta$ is returned to the original value to increase the trim angle $\theta$ (S904, S906).

The explanation on the time t9 to t11 is omitted, as it is the same as that on the time t7 to t9 in the first embodiment.

In the case where the sharp steering is conducted with the gear position in the third speed (at a time point between the time t10 and t11), as indicated by imaginary lines in FIG. 19, when the rudder angle α becomes equal to or greater than the first predetermined angle η at the time ta, the prescribed angle is subtracted from the third-speed learning trim angle ϵ and the obtained difference is used to decrease the trim angle θ (S904, S910). After that, when, at the time tb, the rudder angle α becomes equal to or greater than the second predetermined angle ζ and it is determined to be the sharp steering (S904, S920), the gear position is shifted down from the third speed to the first speed (S930).

The remaining configuration is the same as that in the first embodiment.

As stated above, the first and second embodiments are configured to have an apparatus for controlling operation of an outboard motor (10) adapted to be mounted on a stern of a boat (12) and having an internal combustion engine (30) to power a propeller (42) through a drive shaft (54) and a propeller shaft (44), a transmission (46) that is installed at a location between the drive shaft and the propeller shaft, the transmission being selectively changeable in gear position to establish speeds including at least a first speed and a second speed and transmitting power of the engine to the propeller with a gear ratio determined by established speed, and a trim angle regulation mechanism (power tilt-trim unit) 24 regulating a trim angle θ relative to the boat through trim-up/down operation, comprising: a throttle opening change amount detector (throttle opening sensor 96, ECU 110, S10, S104) that detects a change amount DTH of throttle opening TH of the engine; an engine speed detector (crank angle sensor 102, ECU 110, S10, S108) that detects speed of the engine NE; a rudder angle detector (rudder angle sensor 106, ECU 110, S18, S500, S900) that detects a rudder angle α of the outboard motor relative to the boat; a transmission controller (ECU 110, S10, S120, S126) that controls operation of the transmission to change the gear position from the second speed to the first speed when the second speed is selected and the detected change amount of the throttle opening DTH is equal to or greater than a first predetermined value (acceleration-determining predetermined value) DTHb; and a trim angle controller (ECU 110, S20, S22, S608-S614, S706-S712) that controls operation of the trim angle regulation mechanism to start the trim-up operation such that the trim angle converges to a predetermined angle (second-speed learning trim angle δ, third-speed learning trim angle ϵ when the detected engine speed is equal to or greater than a predetermined speed (third predetermined speed NE3), wherein the trim angle controller controls the operation of the trim angle regulation mechanism such that the trim angle θ is decreased based on the detected rudder angle α when steering of the outboard motor is started (S18, S502, S506, S904, S910, S916).

With this, it becomes possible to prevent cavitation caused by steering of the outboard motor 10, so that the boat 1 can be smoothly turned. To be more specific, the predetermined speed NE3 is set to a value corresponding to the condition immediately before the acceleration is completed and the gear position is changed back from the first speed to the second speed, while the learning trim angles δ, ϵ are set to values with which the water resistance against the boat 1 is decreased to increase the thrust so that the trim-up operation is conducted, thereby increasing the boat speed to reach the maximum speed. In the case where the outboard motor 10 is steered with the maximum boat speed, since the thrust of the boat 1 is temporarily decreased, if the trim angle θ is maintained at the predetermined angle, cavitation may occur. However, the trim angle θ is decreased based on the rudder angle α (the trim-down operation is conducted), it becomes possible to prevent cavitation and the boat 1 can be smoothly turned.

In the apparatus and method, the trim angle controller controls the operation of the trim angle regulation mechanism such that the trim angle θ is increased based on decrease in the detected rudder angle α when the steering of the outboard motor is finished (S18, S502, S504).

With this, it becomes possible to return the trim angle θ to the predetermined angle, thereby increasing the boat speed to again reach the maximum speed.

In the apparatus and method, the transmission establishes speeds including at least a third speed, the transmission controller controls the operation of the transmission to shift up from the first speed to the second speed or from the second speed to the third speed based on the detected engine speed after the trim angle is converged to the predetermined angle δ, ϵ by the trim angle controller (S10, S116, S34, S154, S158), and to shift down when the steering is started and the detected rudder angle is equal to or greater than a predetermined rudder angle (second predetermine angle ζ) after the transmission is shifted up (S18, S904, S922, S930), and the trim angle controller controls the operation of the trim angle regulation mechanism such that the trim angle θ is decreased based on the detected rudder angle α when the steering is started after the transmission is shifted up by the transmission controller (S18, S904, S910, S916).

With this, in addition to the above effects, it becomes possible to effectively prevent cavitation and the boat 1 can be smoothly turned. Specifically, after the engine speed NE becomes equal to or greater than the predetermined speed NE3 and the trim-up operation is conducted, the transmission 46 is shifted up based on the engine speed NE, thereby reliably increasing the boat speed to reach the maximum speed. In the case where the outboard motor 10 is steered with the maximum boat speed, since the trim angle θ is decreased based on the rudder angle α (the trim-down operation is conducted), it becomes possible to prevent cavitation and the boat 1 can be smoothly turned.

Further, when the rudder angle α is equal to or greater than the predetermined angle ζ, i.e., when the steering is relatively large, since the transmission 46 is shifted down, it becomes possible to prevent cavitation further effectively, while decelerating the boat speed without opening/closing the throttle valve 38, so that the boat 1 can be turned further smoothly.

In apparatus and method, the transmission controller controls the operation of the transmission to shift up in response to decrease in the detected rudder angle α after the steering is finished (S18, S904, S932), and the trim angle controller controls the operation of the trim angle regulation mechanism such that the trim angle θ is increased in response to the decrease in the detected rudder angle α (S18, S904, S906).

With this, in addition to the above effects, it becomes possible to change the gear position (which has been shifted down in response to the steering) back to the speed of before the shift down operation and return the trim angle θ to the predetermined angle, thereby increasing the boat speed to reach the maximum speed.

The apparatus and method further include: an actuator (throttle motor) 40 adapted to open and close a throttle valve of the engine; an actuator controller (ECU 110) that controls operation of the actuator such that the engine speed NE becomes a desired engine speed NEa; and a desired engine speed changer (ECU 110, S18, S926) that changes the desired engine speed NEa such that output torque of the engine becomes maximum in a case where the transmission is shifted down by the transmission controller when the steering is started and the detected rudder angle α is equal to or greater than the predetermined rudder angle ζ.

With this, in addition to the above effects, it becomes possible to control the operation of the engine 30 when the transmission 46 is shifted down in response to the steering, thereby preventing revving of the engine speed and enabling the boat 1 to be smoothly turned immediately after the shift down operation.

The apparatus and method further include: a rudder angle change amount calculator (ECU 110, S18, S902) that calculates a change amount of the detected rudder angle Dα, and the transmission controller controls the operation of the transmission to shift down from the third speed to the first speed when the third speed is selected, the detected rudder angle α is equal to or greater than the predetermined rudder angle ζ and the calculated change amount of the rudder angle Dα is equal to or greater than a threshold value Dα1 (S18, S920, S928, S930).

With this, in addition to the above effects, it becomes possible to prevent cavitation, while decelerating the boat speed without opening/closing the throttle valve 38, so that the boat 1 can be turned further smoothly.

In the apparatus and method, the trim angle controller controls the operation of the trim angle regulation mechanism to start the trim-down operation such that the trim angle converges to an initial angle when the detected change amount of the throttle opening is less than a second predetermined value (deceleration-determining predetermined value DTHa) (S10, S24, S106, S176, S800-S810).

With this, in addition to the above effects, the trim angle θ regulated at the predetermined angle can be returned to the initial angle at the right time in accordance with the operating condition of the outboard motor 10. Also, in the case where the trim angle θ is regulated to the predetermined angle next time, since the outboard motor 10 can be trimmed up from the initial angle, it becomes possible to reliably and easily regulate the trim angle θ to the predetermined angle.

The apparatus and method further include: a pitching detector (acceleration sensor 126, ECU 110, S142) that detects a pitching of the boat, and the trim angle controller stops the trim-up operation when the pitching is detected by the pitching detector (S10, S22, S142, S144, S602, S604).

With this, in addition to the above effects, since the trim-up operation can be stopped immediately after the pitching of the hull 12 occurs, it becomes possible to prevent the pitching caused by excessive trim-up operation to the maximum extent.

In the apparatus and method, the trim angle controller restarts the trim-up operation when a predetermined time period elapses after the trim-up operation is stopped (S10, S20, S140, S150, S604, S610).

With this, in addition to the above effects, the trim-up operation can be restarted when the predetermined time period has elapsed and there is no pitching anymore.

It should be noted that, although, in the foregoing, the fixed value (prescribed value) is subtracted from each of the learning trim angles δ, ϵ to decrease the trim angle θ in response to the steering, a value to subtract may be changed in accordance with the rudder angle α, e.g., it may be increased with increasing rudder angle α.

It should also be noted that, although the deceleration/acceleration determining predetermined value DTHa, DTHb, first to third predetermined speeds NE1 to NE3, prescribed angle, first and second predetermined angles η, ζ, displacement of the engine 30 and other values are indicated with specific values in the foregoing, they are only examples and not limited thereto.

Japanese Patent Application Nos. 2010-049671 and 2010-049672, all filed on Mar. 5, 2010 are incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor adapted to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed and transmitting power of the engine to the propeller with a gear ratio determined by established speed, and a trim angle regulation mechanism regulating a trim angle relative to the boat through trim-up/down operation, comprising:

a throttle opening change amount detector that detects a change amount of throttle opening of the engine;

an engine speed detector that detects speed of the engine;

a rudder angle detector that detects a rudder angle of the outboard motor relative to the boat;

a transmission controller that controls operation of the transmission to change the gear position from the second speed to the first speed when the second speed is selected and the detected change amount of the throttle opening is equal to or greater than a first predetermined value; and a trim angle controller that controls operation of the trim angle regulation mechanism to start the trim-up operation such that the trim angle converges to a predetermined angle when the detected engine speed is equal to or greater than a predetermined speed, wherein the trim angle controller controls the operation of the trim angle regulation mechanism such that the trim angle is decreased based on the detected rudder angle when steering of the outboard motor is started.

2. The apparatus according to claim 1, wherein the trim angle controller controls the operation of the trim angle regulation mechanism such that the trim angle is increased based on decrease in the detected rudder angle when the steering of the outboard motor is finished.

3. The apparatus according to claim 1, wherein the transmission establishes speeds including at least a third speed, the transmission controller controls the operation of the transmission to shift up from the first speed to the second speed or from the second speed to the third speed based on the detected engine speed after the trim angle is converged to the predetermined angle by the trim angle controller, and to shift down when the steering is started and the detected rudder angle is equal to or greater than a predetermined rudder angle after the transmission is shifted up, and the trim angle controller controls the operation of the trim angle regulation mechanism such that the trim angle is decreased based on the detected rudder angle when the steering is started after the transmission is shifted up by the transmission controller.

4. The apparatus according to claim 3, wherein the transmission controller controls the operation of the transmission to shift up in response to decrease in the detected rudder angle after the steering is finished, and the trim angle controller controls the operation of the trim angle regulation mechanism such that the trim angle is increased in response to the decrease in the detected rudder angle.

5. The apparatus according to claim 3, further including:

an actuator adapted to open and close a throttle valve of the engine;

an actuator controller that controls operation of the actuator such that the engine speed becomes a desired engine speed; and a desired engine speed changer that changes the desired engine speed such that output torque of the engine becomes maximum in a case where the transmission is shifted down by the transmission controller when the steering is started and the detected rudder angle is equal to or greater than the predetermined rudder angle.

6. The apparatus according to claim 3, further including:

a rudder angle change amount calculator that calculates a change amount of the detected rudder angle, and the transmission controller controls the operation of the transmission to shift down from the third speed to the first speed when the third speed is selected, the detected rudder angle is equal to or greater than the predetermined rudder angle and the calculated change amount of the rudder angle is equal to or greater than a threshold value.

7. The apparatus according to claim 1, wherein the trim angle controller controls the operation of the trim angle regulation mechanism to start the trim-down operation such that the trim angle converges to an initial angle when the detected change amount of the throttle opening is less than a second predetermined value.

8. The apparatus according to claim 1, further including:

a pitching detector that detects a pitching of the boat, and the trim angle controller stops the trim-up operation when the pitching is detected by the pitching detector.

9. The apparatus according to claim 8, wherein the trim angle controller restarts the trim-up operation when a predetermined time period elapses after the trim-up operation is stopped.

10. A method for controlling operation of an outboard motor adapted to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed and transmitting power of the engine to the propeller with a gear ratio determined by established speed, and a trim angle regulation mechanism regulating a trim angle relative to the boat through trim-up/down operation, comprising the steps of:

detecting a change amount of throttle opening of the engine;

detecting speed of the engine;

detecting a rudder angle of the outboard motor relative to the boat;

controlling operation of the transmission to change the gear position from the second speed to the first speed when the second speed is selected and the detected change amount of the throttle opening is equal to or greater than a first predetermined value; and controlling operation of the trim angle regulation mechanism to start the trim-up operation such that the trim angle converges to a predetermined angle when the detected engine speed is equal to or greater than a predetermined speed, wherein the step of trim angle controlling controls the operation of the trim angle regulation mechanism such that the trim angle is decreased based on the detected rudder angle when steering of the outboard motor is started.

11. The method according to claim 10, wherein the step of trim angle controlling controls the operation of the trim angle regulation mechanism such that the trim angle is increased based on decrease in the detected rudder angle when the steering of the outboard motor is finished.

12. The method according to claim 10, wherein the transmission establishes speeds including at least a third speed, the step of transmission controlling controls the operation of the transmission to shift up from the first speed to the second speed or from the second speed to the third speed based on the detected engine speed after the trim angle is converged to the predetermined angle by the step of trim angle controlling, and to shift down when the steering is started and the detected rudder angle is equal to or greater than a predetermined rudder angle after the transmission is shifted up, and the step of trim angle controlling controls the operation of the trim angle regulation mechanism such that the trim angle is decreased based on the detected rudder angle when the steering is started after the transmission is shifted up by step of transmission controlling.

13. The method according to claim 12, wherein the step of transmission controlling controls the operation of the transmission to shift up in response to decrease in the detected rudder angle after the steering is finished, and the step of trim angle controlling controls the operation of the trim angle regulation mechanism such that the trim angle is increased in response to the decrease in the detected rudder angle.

14. The method according to claim 12, further including the steps of:

controlling operation of an actuator adapted to open and close a throttle valve of the engine such that the engine speed becomes a desired engine speed; and changing the desired engine speed such that output torque of the engine becomes maximum in a case where the transmission is shifted down by the step of transmission controlling when the steering is started and the detected rudder angle is equal to or greater than the predetermined rudder angle.

15. The method according to claim 12, further including the step of:

calculating a change amount of the detected rudder angle, and the step of transmission controlling controls the operation of the transmission to shift down from the third speed to the first speed when the third speed is selected, the detected rudder angle is equal to or greater than the predetermined rudder angle and the calculated change amount of the rudder angle is equal to or greater than a threshold value.

16. The method according to claim 10, wherein the step of trim angle controlling controls the operation of the trim angle regulation mechanism to start the trim-down operation such that the trim angle converges to an initial angle when the detected change amount of the throttle opening is less than a second predetermined value.

17. The method according to claim 10, further including the step of:

detecting a pitching of the boat, and the step of trim angle controlling stops the trim-up operation when the pitching is detected by the step of pitching detecting.

18. The method according to claim 17, wherein the step of trim angle controlling restarts the trim-up operation when a predetermined time period elapses after the trim-up operation is stopped.

* * * * *